United States Patent [19]

Ishikawa et al.

[11] Patent Number: 4,863,836

[45] Date of Patent: Sep. 5, 1989

[54] METHOD FOR PROCESSING SILVER HALIDE COLOR PHOTOGRAPHIC MATERIALS AND COLOR PHOTOGRAPHIC DEVELOPING COMPOSITION

[75] Inventors: Takatoshi Ishikawa; Nobutaka Ohki; Morio Yagihara, all of Minami-ashigara, Japan

[73] Assignee: Fuji Photo Film, Co., Inc., Kanagawa, Japan

[21] Appl. No.: 158,470

[22] Filed: Feb. 22, 1988

[30] Foreign Application Priority Data

Feb. 20, 1987 [JP] Japan ..... 62-37351

[51] Int. Cl.[4] ..... G03C 1/02; G03C 7/16; G03C 5/24; G03C 7/26

[52] U.S. Cl. ..... 430/372; 430/384; 430/385; 430/470; 430/471; 430/473; 430/486; 430/490; 430/491; 430/552; 430/553; 430/583; 430/607

[58] Field of Search ..... 430/372, 491, 470, 473, 430/471, 552, 553, 607, 490, 486, 384, 385

[56] References Cited

U.S. PATENT DOCUMENTS 4,588,677 5/1986 Ishikawa et al. ..... 430/387

FOREIGN PATENT DOCUMENTS 0266797 5/1988 European Pat. Off. .
62275258 12/1970 Japan .
61147823 8/1975 Japan .
634234 10/1976 Japan .
634235 3/1977 Japan .
61147822 4/1979 Japan .
61114277 11/1980 Japan .

*Primary Examiner*—Mukund J. Shah
*Attorney, Agent, or Firm*—Sughrue, Mion, Zinn, Macpeak & Seas

[57] ABSTRACT

There is provided a method for processing a silver halide color photographic material which comprises processing the silver halide color photographic material with a color developer containing an aromatic primary amine color developing agent and a specific amino compound. According to this method the stability and color forming property of a color developer are improved so that the increased fogging problem in continuous processing is lessened and the processing time is shortened. There is also provided a color developer composition which can be used as the developer, as it is or after adjusting its composition.

20 Claims, No Drawings

METHOD FOR PROCESSING SILVER HALIDE COLOR PHOTOGRAPHIC MATERIALS AND COLOR PHOTOGRAPHIC DEVELOPING COMPOSITION

BACKGROUND OF THE INVENTION (1) Field of the Invention

The present invention relates to a method for processing a silver halide color photographic material and a color photographic developing composition used in the method, and more particularly to a method for processing a silver halide color photographic material in which the stability and the color-forming property of a color photographic developing solution are improved, and the increased fogging problem in continuous processing is lessened; and a color developing composition which can afford the color developing solution.

(2) Description of the Prior Art

Color developing solutions containing an aromatic primary amine color developing agent have long been used for forming color images, and they now play a main role in methods of forming color photographic images. However, it is well known that these color developing solutions have the disadvantage of oxidizing easily with air or metals, and if color images are formed using oxidized color developing solution there is increased fogging or the sensitivity or gradation changes, thus interfering with the desired photographic properties.

Accordingly, hitherto various means of improving the preservative property of color developing solutions were studied, and, in particular, means using both hydroxyl amine and sulfite ions are most generally practiced. However, since hydroxyl amine when decomposed releases ammonia, which causes fogging, and since sulfite ions disadvantageously hamper, for example, the color-forming property when used as a competing compound in a developing agent, it is difficult to consider them preferable compounds (preservatives) to improve the preservative property of color developing solutions.

Although sulfite ions, in particular, have long been used to improve the preservative property of various developing agents or to prevent hydroxyl amines from decomposing, they greatly hamper the color-forming property and markedly lower the color density. Especially when the sulfite ion is used in a system free of benzyl alcohol which is desirable to avoid the solution-preparation and environmental pollution problems involved with benzyl alcohol.

As compounds that can substitute for sulfites were suggested alkanolamines, described in Japanese Patent Application (OPI) No. 3532/1979, and polyethyleneimines, described in Japanese Patent Application (OPI) 94349/1981. Even if these compounds are used, however, they do not achieve enough desirable effects.

To improve the stability of color developing solutions, various preservatives and chelating agents have hitherto been studied. For example, as preservatives can be mentioned aromatic polyhydroxy compounds described, for example, in Japanese Patent Application (OPI) Nos. 49828/1977, 160142/1984, and 47038/1981 and U.S. Pat. No. 3,746,544, hydroxycarbonyl compounds described in U.S. Pat. No. 3,615,503 and British Patent No. 1,306,176, α-aminocarbonyl compounds described in Japanese Patent Application (OPI) Nos. 143020/1977 and 89425/1978, metal salts described in Japanese Patent Application (OPI) Nos. 44148/ 1982 and 53749/1982, and hydroxamic acids described in Japanese Patent Application (OPI) No. 27638/1977. As chelating agents can be mentioned amino polycarboxylic acids described in Japanese Patent Publication Nos. 30496/1973 and 30232/1969; organic phosphonic acids described in Japanese Patent Application (OPI) No. 97347/1981, Japanese Patent Publication No. 39359/1981, and West German Patent No. 2,227,639; phosphonocarboxylic acids described, for example, in Japanese Patent Application (OPI) Nos. 102726/1977, 42730/1978, 121127/1979, 126241/1980, and 65956/1980; compounds described, for example, in Japanese Patent Application (OPI) Nos. 195845/1983 and 203440/1983 and Japanese Patent Publcation No. 40900/1978; and organic phosphonic acid type chelating agents described in Research Disclosure Nos. 18837 and 17048.

Satisfactory results, however, have not yet been obtained, because if organic phosphonic acid type chelating agents of the present invention and the above technique are used, the preservative property is not enough and the photographic characteristics are adversely affected.

Further, it is described in Japanese Patent Application (OPI) Nos. 95345/1973 and 232342/1984 that color photographic materials containing a silver chlorobromide emulsion with a high chlorine content are liable to cause fogging when the materials are color-developed. If such an emulsion is used it is essential to use a preservative that dissolved less in the emulsion and has better preservative performance, and in this sense satisfactory preservatives have not yet been found.

BRIEF SUMMARY OF THE INVENTION

Therefore, an object of the invention is to provide a method of processing silver halide color photographic material wherein the stability of the color developing solution is excellent and the increase in fogging during continuous processing is very low.

A further object of the invention is to provide a method of processing a silver halide color photographic material that is excellent in color-forming property regardless of the fact that it is processed with a color developing solution substantially free from benzyl alcohol.

Still a further object of the invention is to provide a color developing solution excellent in stability, color-forming property and the prevention of solution-preparation and environmental polution problems.

Other and further objects, features, and advantages of the invention will appear more fully from the following description.

DETAILED DESCRIPTION OF THE INVENTION

The above objects have been attained by a method of processing a silver halide color photographic material in which the silver halide color photographic material is processed with a color developing solution containing an aromatic primary amine color developing agent, at least one organic phosphonic acid type chelating agent and at least one compound represented by formula (I) given below.

Formula (I)

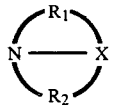

wherein X represents a trivalent group of atoms required to complete a condensed ring, and $R_1$ and $R_2$, which may be the same or different, each represent an alkylene group, an arylene group, an alkenylene group, or an aralkylene group.

Further the above objects can be attained by a color developing composition for processing a silver halide color photographic material, which comprises an aromatic primary amine color developing agent, at least one organic phosphonic acid type chelating agent and a compound represented by the above formula (I). The color developing composition may be used as a color developing solution, as it is, or after adjusting its composition.

Japanese Patent Application No. 265149/1986 has described that compounds represented by formula (I) improve the stability of color developing solutions. However, the present invention is distinguished from the application in that the compound is used with an organic phosphonic acid chelating agent and the effect of the present invention is remarkable.

In formula (I) the number of carbon atoms of X is preferably 20 or below, more preferably 10 or below, and even more preferably 6 or below. X may include atoms of, for example, nitrogen, oxygen, and sulfur.

In formula (I) the number of carbon atom of $R_1$ and $R_2$ is preferably 10 or below, more preferably 6 or below, and even more preferably 3 or below. Preferably $R_1$ and $R_2$ are an alkylene group or an arylene group, more preferably an alkylene group.

The compounds represented by formula (I) may be in a bis-form or a tris-form connected through X.

Specific examples of X of formula (I) include

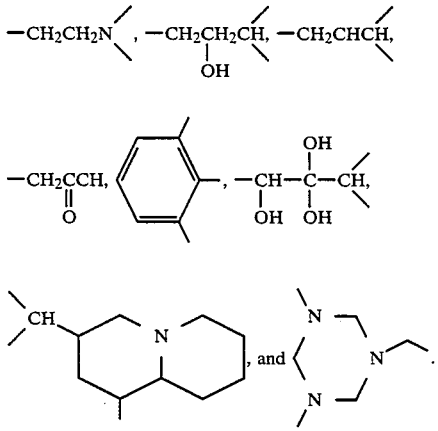

Specific examples of $R_1$ and $R_2$ of formula (I) include a methylene group, an ethylene group, a propylene group, a butylene group, a pentylene group, a 1,2-cyclohexylene group, a 1-methylethylene group, a 1,2-dimethylethylene group, a 1-carboxyethylene group, a 1,2-phenylene group, a 1,2-vinylene group, and a 1,3-propenylene group, which may be substituted, for example, by an alkyl group, a halogen atom, a carboxyl group, a sulfo group, a hydroxyl group, an alkoxy group, an alkylthio group, an amino group, an amide group, an acyl group, a carbamoyl group, a sulfamoyl group, or a heterocyclic ring group.

Of the compounds represented by formula (I), particularly preferable compounds are those represented by formulae (I-a) and (I-b):

Formula (I-a)

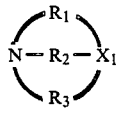

wherein X represents

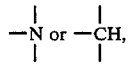

$R_1$ and $R_2$ have the same meaning as defined above for formula (I), and $R_3$ has the same meaning as $R_1$ or $R_2$ or represents

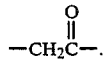

In formula (I-a), preferably X represents

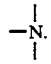

Preferably the number of carbon atoms of $R_1$, $R_2$, and $R_3$ is 6 or below, more preferably 3 or below, and most preferably 2.

Preferably $R_1$, $R_2$, and $R_3$ represents an alkylene group or an arylene group, most preferably an alkylene group.

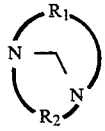

wherein $R_1$ and $R_2$ have the same meaning as defined in formula (I).

In formula (I-b), preferably the number of carbon atoms of $R_1$ and $R_2$ is 6 or below. Preferably $R_1$ and $R_2$ represent an alkylene group or an arylene group, most preferably an alkylene group.

Of compounds represented by formulae (I-a) and (I-b), those represented by formula (I-a) are preferable.

Specific examples of compounds represented by formula (I) are given below, but the invention is not limited to these compounds.

I-(1)

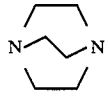

(DABCO)

-continued

I-(2)

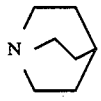

I-(3)

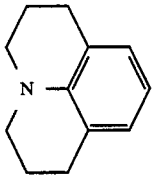

I-(4)

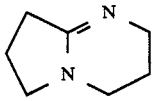

(DBN)

I-(5)

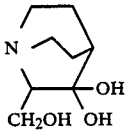

I-(6)

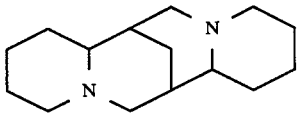

I-(7)

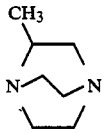

I-(8)

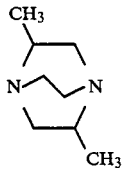

I-(9)

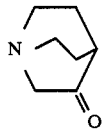

I-(10)

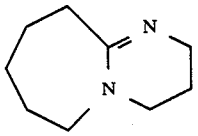

(DBU)

I-(11)

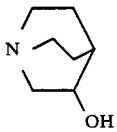

-continued

I-(12)

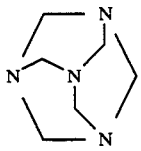

I-(13)

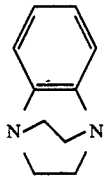

I-(14)

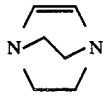

I-(15)

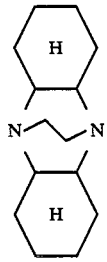

I-(16)

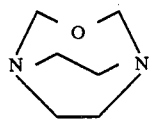

I-(17)

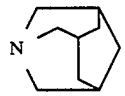

I-(18)

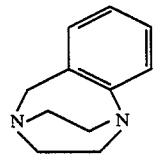

Most of the compounds represented by formula (I) according to the invention can be available commercially easily.

The amount of the compounds of formula (I) to be added is preferably 0.1 g to 50 g, more preferably 0.2 to 20 g, per liter of a color developing solution.

Organic phosphonic acid type chelating agents used in the present invention will now be described.

The organic phosphonic acids used in the invention may be any of organic phosphonic acids such as alkylphosphonic acids, phosphonocarboxylic acids and amonopolyphosphonic acids. They are given by the following formulae:

$$B-A_1-Z-A_2-C \qquad \text{Formula (II)}$$

-continued

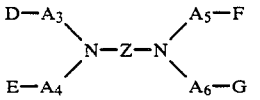

Formula (III)

In formulae (II) and (III), $A_1$ to $A_6$ each represents a substituted or unsubstituted alkylene group; Z represents an alkylene group, a cyclohexane group, a phenylene group, —R—O—R—, —RORORO—,

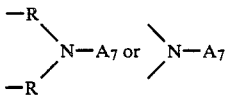

in which R represents an alkylene group and $A_7$ represents a hydrogen atom, a hydrocarbon, a lower aliphatic carboxylic acid or a lower alcohol; and B, D, E, F and G each represent —OH, —COOM, or $—PO_3M_2$ in which M represents a hydrogen atom, an alkali metal, or ammonium, provided that at least one of B, C, D, E, F, and G is $—PO_3M_2$.

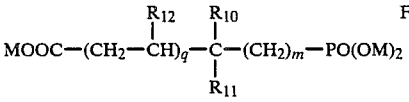

Formula (IV)

wherein $R_{10}$ represents —COOM or —PO(OM), $R_{11}$ represents a hydrogen atom, a $C_1$–$C_4$ alkyl group, $—(CH_2)_{n'}COOM$, or a phenyl group, $R_{12}$ represents a hydrogen atom or —COOM, M represents a hydrogen atom, an alkali metal, or ammonium, m is 0 or 1, n' is an integer of 1 to 4, and q is 0 or 1, provided that when m=0, then $R_{10}=—PO(OM)_2$.

$R_{13}N(CH_2PO_3M_2)_2$ Formula (V)

wherein $R_{13}$ represents a lower alkyl group, an aryl group, an aralkyl group, or a 6-membered nitrogen-containing cyclic group which may be substituted by —OH, $—OR_{14}$ ($R_{14}$ represents a $C_1$–$C_4$ alkyl group), $—PO_3M_2$, $—CH_2PO_3M_2$, $—N(CH_2PO_3M_2)_2$, $—COOM_2$, or $—N(CH_2COOM_2)$, and M represents a hydrogen atom, an alkali metal, or ammonium.

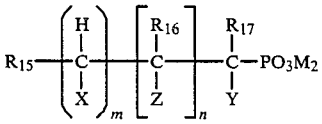

Formula (VI)

wherein $R_{15}$ and $R_{16}$ each represent a hydrogen atom, a lower alkyl group, —COOH, or $NJ_2$ in which J represents H, OH, a lower alkyl group, or $—CH_2H_4OH$;

$R_{17}$ represents a hydrogen atom, a lower alkyl group, —OH, or $—NL_2$ in which L represents H, OH, $—CH_3$, $—C_2H_5$, $—C_2H_4OH$, or $—PO_3M_2$;

X, Y and Z each represent —OH, —COOM, $PO_3M_2$, or H;

M represents hydrogen, an alkali metal, or ammonium;

n is 0 or an integer of 1 or higher; and m is 0 or 1.

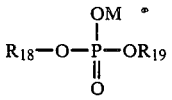

Formula (VII)

wherein $R_{18}$ and $R_{19}$ each represent a hydrogen atom, an alkali metal, ammonium, a $C_1$–$C_{12}$ substituted or unsubstituted alkyl group, an alkynyl group, or a cycloalkyl group.

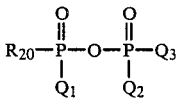

Formula (VIII)

$R_{20}$ represents a $C_1$–$C_{12}$ alkyl group, a $C_1$–$C_{12}$ alkoxy group, a $C_1$–$C_{12}$ monoalkylamino group, a $C_2$–$C_{12}$ dialkylamino group, an amino group, a $C_1$–$C_{24}$ alyloxy group, a $C_6$–$C_{24}$ arylamino group, or an amyloxy group, and $Q_1$ to $Q_3$ each represent —OH, a $C_1$–$C_{24}$ alkoxy group, an aralkyloxy group, an alyloxy group, $—OM_3$ in which $M_3$ represents a cation, an amino group, a morpholino group, a cyclic amino group, an alkylamino group, a dialkylamino group, an arylamino group, or an alkyloxy group.

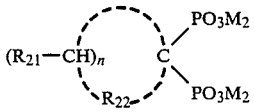

wherein $R_{21}$ and $R_{22}$ each represent a hydrogen atom, a lower alkyl group, or an imine which may be substituted by a lower alkyl group or a $CH_2CH_2COONa$;

M represents a hydrogen atom, an alkali metal, or ammonium; and n is an integer of 2 to 16.

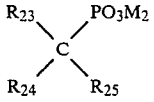

$R_{23}$ to $R_{25}$ each represents hydrogen or an alkyl group which may be substituted by —OH, $—OC_{n''}H_{2n''+1}$ wherein n'' is 1 to 4, $—PO_3M_2$, $—CH_2PO_3M$, —NR'2 wherein R' represents an alkyl group, or $—N(CH_2PO_3M_2)_2$, and M represents a hydrogen atom, an alkali metal, or ammonium.

In the formulae (II) to (X), the term "lower alkyl group" means a group having 5 or less carbon atoms.

Specific examples of the compounds represented by formulae (II) to (X) are as follows:

(1)
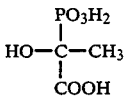
(2)
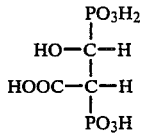
(3)
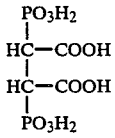
(4)
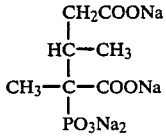
(5)
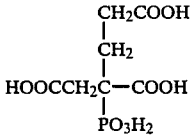
(6)
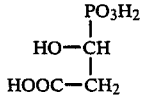
(7)
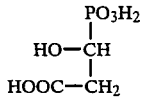
(8)
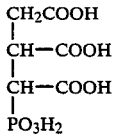
(9)
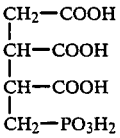
(10)
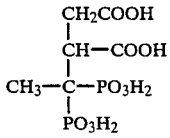
(11)
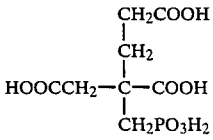
-continued
(12)
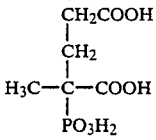
(13)
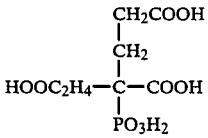
(14)
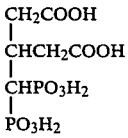
(15)
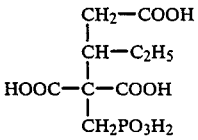
(16)
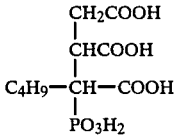
(17)
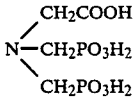
(18)
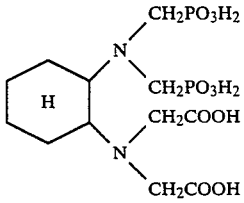
(19)
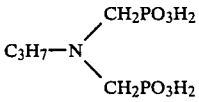
(20)
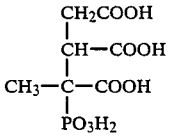
(21)
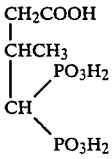
(22)
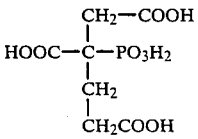

-continued
(23)
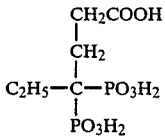
(24)
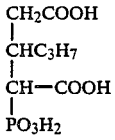
(25)
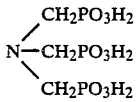
(26)
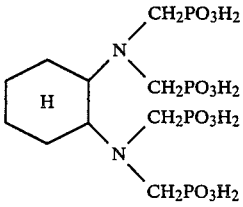
(27)
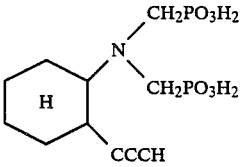
(28)
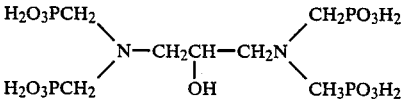
(29)
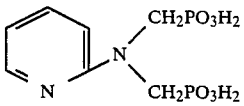
(30)
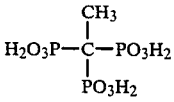
(31)
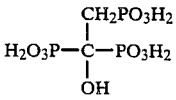
(32)
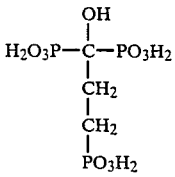
(33)
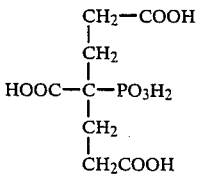
-continued
(34)
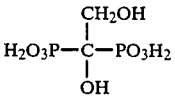
(35)
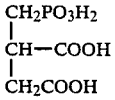
(36)
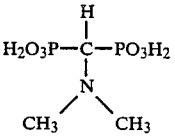
(37)
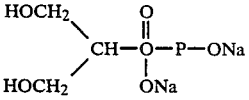
(38)
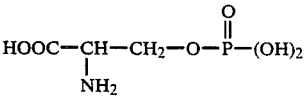
(39)
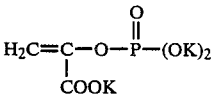
(40)
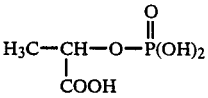
(41)
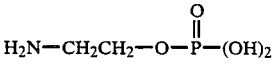
(42)
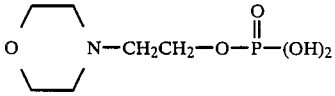
(43)
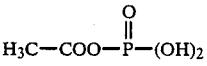
(44)
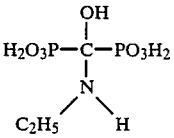
(45)
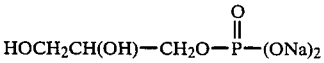
(46)
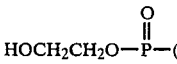
(47)
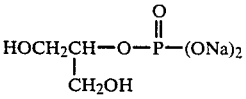
(48)
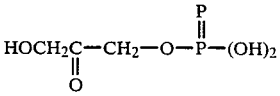

-continued (49)

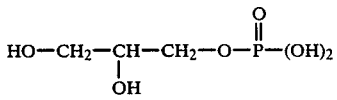

(50)

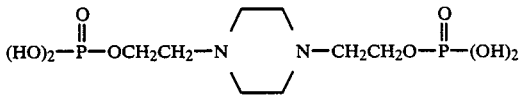

(51)

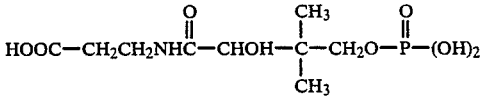

(52)

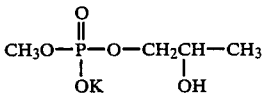

(53)

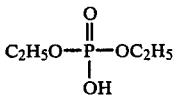

(54)

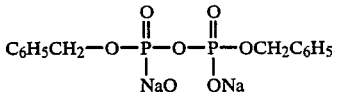

(55)

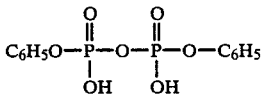

(56)

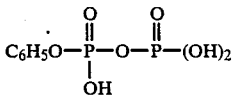

(57)

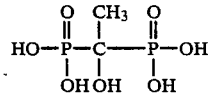

(58)

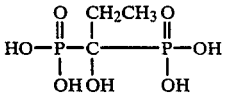

(59)

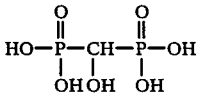

(60)

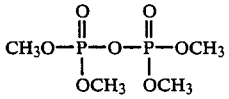

(61)

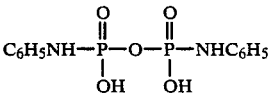

(62)

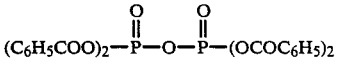

(63)

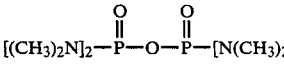

-continued (64)

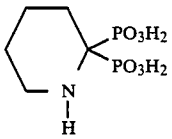

(65)

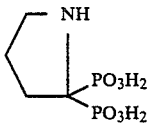

(66)

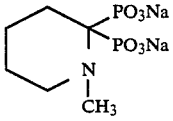

(67)

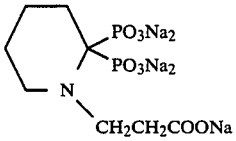

(68)

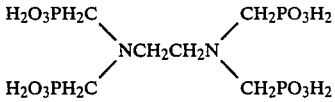

These compounds are added in an amount of 0.1 to 40 g, preferably 0.2 to 10 g, per liter of a color developing solution. Of the above compounds, those represented by formula (III) are most preferable.

Examples of the color developing solution used in the present invention may include a conventional aromatic primary amine color developing agent. Preferred examples of aromatic primary amine color developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl-)amino]aniline
D-6: 4-amino-3-methyl-N-ethyl-N-[β-(methanesulfonamido)ethyl]-aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) is especially preferable.

These p-phenylenediamine derivatives may be in the form of salts such as sulfates, hydrochlorides, sulfites, and p-toluenesulfonates. The amount of the aromatic primary amine developing agent to be used is preferably about 0.1 g to about 20 g, more preferably about 0.5 to about 10 g, per liter of developing solution.

If required an arbitrary development accelerator may be added to the color developing solution. However, to prevent environmental contamination, and also fogging, it is preferable that the present color developing solution be substantially free of benzyl alcohol. Herein the term "substantially free of benzyl alcohol" means that the amount of benzyl alcohol per liter of color developing solution is no more than 2 ml, but more preferably benzyl alcohol should not be contained at all.

If required as a preservative, a sulfite such as sodium sulfite, potassium sulfite, sodium bisulfite, potassium bisulfite, sodium metasulfite, and potassium metasulfite, or a carbonyl sulfite adduct may be added to the color developing solution. The preservative may be added in an amount of 0 g to 20 g, preferably 0 g to 5 g, per liter of developing solution. A smaller amount is preferable, provided that the stability of the color developing solution is retained.

Further, it is preferable to add a compound to preserve directly the above-mentioned developing agent, such as hydroxylamines, hydroxamic acids described in Japanese Patent Application No. 186559/1986, hydrazines and hydrazides described in Japanese Patent Application No. 170756/1986, phenols described in Japanese Patent Application Nos. 188742/1986 and 203253/1986, α-hydroxyketones and α-aminoketones described in Japanese Patent Application No. 188741/1986, and/or succharides described in Japanese Patent Application No. 180616/1986, in combination with a compound represented by formula (I).

If required, other preservatives may also be contained, such as, metals described in Japanese Patent Application (OPI) Nos. 44148/1982 and 53749/1982, salicyclic acids described in Japanese Patent Application (OPI) No. 180588/1984, alkanolamines described in Japanese Patent Application (OPI) No. 3532/1979, polyethyleneimines described in Japanese Patent Application (OPI) No. 94349/1981, and aromatic polyhydroxy compounds described in U.S. Pat. No. 3,746,544.

Preferably the pH of the color developing solution of the present invention is in the range of 9 to 12, more preferably 9 to 11.0, and other known compounds that are components of a conventional developing solution can be contained.

To maintain the above-mentioned pH-value, it is preferable to use various buffer agents. Buffer agents that can be used include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. In particular, carbonates, phosphates, tetraborates, and hydroxybenzoates are excellent in solubility and buffer performance at a high pH of 9.0 or above, and when added to the color developing solution there are no adverse effects (e.g., fogging) on photographic performance. Additionally they are inexpensive, so it is particularly preferable to use these buffer agents.

Examples of these buffer agents are sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However the present invention is not limited to these compounds.

Preferably the amount of the buffer agent to be added to the color developing solution is 0.1 mol/liter or over, more preferably 0.1 to 0.4 mol/liter.

Various chelating agents other than organic phosphonic acid series can be used together in the color developing solution.

Examples of the chelating agents that can be used together are given below, but the present invention is not limited to them: nitrilotriacetic acid, dietylentriaminepentaacetic acid, ethylenediaminetetraacetic acid, transcyclohexanediaminetetraacetic acid, 1,2-diaminopropanetetraacetic acid, glycol ether diaminetetraacetic acid, ethylendiamineorthohydroxyphenylacetic acid, N,N'-bis(2-hydroxybenzyl)ethylenediamine-N,N'-diacetic acid, and hydroxyethyliminodiacetic acid.

Two or more of these chelating agents may be combined if required.

Various development accelerators may be added to the color developing solution if required. Examples of development accelerators that can be mentioned are thioether type compounds described in Japanese Patent Publication Nos. 16088/1962, 5987/1962, 7826/1963, 12380/1969, 9019/1970, and U.S. Pat. No. 3,813,247; p-phenylenediamine compounds described in Japanese Patent Application (OPI) Nos. 49829/1977 and 15554/1975; quaternary ammonium salts described in Japanese Patent Application (OPI) No. 137726/1975, Japanese Patent Publication No. 30074/1969, Japanese Patent Application (OPI) Nos. 156826/1981 and 43429/1979; amine type compounds described in U.S. Pat. Nos. 2,494,903, 3,128,182, 4,230,796 and 3,253,919, Japanese Patent Publication No. 11431/1966 and U.S. Pat. Nos. 2,482,546, 2,596,926 and 3,582,346; polyalkylene oxides described in Japanese Patent Publication Nos. 16088/1962 and 25201/1967, U.S. Patent No. 3,128,183, Japanese Patent Publication Nos. 11431/1966 and 23883/1967 and U.S. Pat. No. 3,532,501; and 1-phenyl-3-pyrazolidones and imidazoles.

In the present invention an arbitrary antifoggant may be added if required. Antifoggants that can be added include alkali metal halides such as sodium chloride, potassium bromide, and potassium iodide, and organic antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethylbenzimidazole, indazoles, hydroxyazindolizine, and adenine.

If required, surface active agents such as alkyl sulfonic acids, aryl phosphonic acids, aliphatic carboxylic acids, and aromatic carboxylic acids may be added.

The processing temperature using the present color developing solution is between 20° to 50° C., preferably 30° to 40° C. The processing time is between 20 sec. to 5 min., preferably 30 sec. to 2 min. It is preferable to use a smaller amount of reprenisher, generally 20 to 600 ml, preferably 50 to 300 ml, and more preferably 100 to 200 ml, per $m^2$ of the photographic material. The shorter the developing time the beffer for attaining the remarkable effect of the present invention.

Next are described the bleaching solution, the bleach-fixing solution, and the fixing solution used in the present invention.

Though any bleaching agent may be used in the bleaching solution or the bleach-fixing solution of the present invention, it is preferable to use organic complex salts of iron (III) (e.g., complex salts of aminopolycarboxylic acids such as ethylenediaminetetraacetic acid and diethylenetriaminepentaacetic acid, aminopolyphosphonic acids, phosphonocarboxylic acids, and organic phosphonic acids); organic acids such as citric acid, tartaric acid, and malic acid; and persulfates and hydrogen peroxide.

Of these, organic complex salts of iron (III) are particularly preferable to achieve rapid processing and to prevent environmental contamination. Aminopolycarboxylic acids, aminopolyphosphonic acids, and organic phosphonic acids or their salts useful for forming organic complex salts of iron (III) include ethylenediaminetetraacetic acid, diethylenetriaminetetraacetic acid, 1,3-diaminopropanetetraacetic acid, propylenediaminetetraacetic acid, nitrilotriacetic acid, cyclohexanediaminetetraacetic acid, methyliminodiacetic acid, and glycol ether diaminetetraacetic acid. These compounds may be any one of sodium salt, potassium salt, lithium salt, and ammonium salt. Of these compounds it is preferable to use ethylenediaminetetraacetic acid, diethylenetriaminepentaacetic acid, cyclohexanediaminetetraacetic acid, 1,3-diaminopropanetetraacetic acid, or methyliminodiacetic acid, since their bleaching power is high.

These ferric ion complex salts may be used in the form of a complex salt, or a ferric ion complex salt may be formed in solution using a ferric salt such as ferric sulfate, ferric chloride, ferric nitrate, ammonium iron (III) sulfate, and ferric phosphate and chelating agent such as an aminopolycarboxylic acid, an aminopolyphosphonic acid, and a phosphonocarboxylic acid. One or more complex salts may be used. On the other hand, one or more ferric salts can be used to form complex salts in solution by using ferric salts and a chelating agent. Further, one or more chelating salts may be used. In either case a chelating agent is used in excess to form a ferric ion complex salt. Of iron complex salts, aminopolycarboxylic acid iron complex salts are preferable, and the amount used is 0.01 to 1.0 mol/liter, preferably 0.05 to 0.50 mol/liter.

Further, if required, the bleaching solution and the bleach-fixing solution and/or their preceding bath solution may have a bleach accelerating agent. As specific examples of useful bleach accelerating agents can be mentioned compounds having a mercapto group or a disulfido group described, for example, in U.S. Pat. No. 3,893,858, West German Patent No. 1,290,812, Japanese Patent Application (OPI) No. 95630/1978, and Research Disclosure No. 171129 (July 1978), thiourea derivatives described in Japanese Patent Publication No. 8506/1970, Japanese Patent Application (OPI) Nos. 20832/1977 and 32735/1978 and U.S. Pat. No. 3,706,561, and halide compounds (iodide, bromide). These compounds are preferable in view of high acceleration effects.

Further, the bleaching solution or the bleach-fixing solution used in the present invention may contain a rehalogenating agent such as bromide (e.g., potassium bromide, sodium bromide, and ammonium bromide), a chloride (e.g., potassium chloride, sodium chloride, and ammonium chloride) or an iodide (e.g., ammonium iodide). If needed, one or more inorganic acids or organic acids and their metal salts or ammonium salts having a pH buffering effect can be added, such as boric acid, borax, sodium metaborate, acetic acid, sodium acetate, sodium carbonate, potassium carbonate, phoshorous acid, phosphonic acid, sodium phosphate, citric acid, sodium citrate and tartaric acid; or a corrosion inhibitor such as guanidine or ammonium nitrate.

The fixing agent used in the bleach-fixing solution or the fixing solution of the present invention can be a known fixing agent. That is, a dissolving agent of water-soluble silver halide, for example a thiosulfate such as sodium thiosulfate or ammonium thiosulfate; a thiocyanate such as sodium thiocyanate or ammonium thiocyanate; a thioether compound such as ethylenebisthioglycolic acid or 3,6-dithia-1,8-octanediol; or a thiourea. Two or more of these compounds may be combined. Further, a special bleach-fixing solution comprising a combination of a large amount of a halide such as potassium iodide and a fixing agent described in Japanese Patent Application (OPI) No. 155354/1980 can be used. In the present invention it is preferable to use a thiosulfate, particularly ammonium thiosulfate. The amount of a fixing agent to be used per liter of the bath is preferably in the range of 0.3 to 2 mol, more preferably 0.5 to 1.0 mol. The pH range of the bleach-fixing solution or the fixing solution is preferably in the range of 3 to 10, more preferably 5 to 9.

Further, the bleach-fixing solution can contain a brightening agent, an antifoamer, a surface active agent, or an organic solvent such as polyvinylpyrolidone and methanol.

The bleach-fixing solution or the fixing solution in the present invention contains, as a preservative, a sulfite ion releasing compound such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). Preferably these compounds are contained in an amount of about 0.2 to 0.50 mol/liter, more preferably 0.04 to 0.40 mol/liter, in terms of sulfite ion.

Although a sulfite is generally added as a preservative, an ascorbic acid and a carbonyl-bisulfite adduct or a carbonyl compound can be added.

Further, there may be added, if required, a buffering agent, brightening agent, chelating agent, or antifungal agent.

In the present invention, a shorter processing time of the desilvering step shows a more marked effect, so the time of the desilvering step is preferably 2 min. or less, more preferably 1 min. or less.

The silver halide color photographic material used in the present invention is generally passed through a washing step and/or a stabilizing step after the desilvering process of fixing or bleach-fixing.

The amount of washing water in the washing step can be set in a wide range depending on the properties of the photographic material (for example, due to the material used, such as couplers), the uses of the photographic material, the temperature of the washing water, the number of washing tanks (number of steps), the type of replenishing mode such as counter-current mode or concurrent mode, and other conditions. The relationship between the number of washing tanks and the amount of water in the multistage counter-current mode can be determined according to a method described in *Journal of the Society of Motion Picture and Television Engineers,* Vol. 64, pp. 248–253 (May 1955). The number of steps of the multistage counter-current washing mode is preferably 2 to 6, more preferably 2 to 4.

With to the multistage counter-current method the effect of the present invention appears more remarkable. For example, the amount of washing water can be decreased considerably, below 1 liter, preferably 0.5 liter, per $m^2$ of photographic material. However, bacteria propagate due to the increased time the water remains in the tanks, causing problems such as the adhesion of resulting suspended matter on the photographic material. To solve such problems in the present method of processing a color photographic material, a method of decreasing calcium and magnesium described in Japanese Patent Application No. 131632/1986 can be used very effectively. Further, agents that can be used include isothiazolone and cyabendazole compounds described in Japanese Patent Application (OPI) No. 8542/1982, chlorine-type bactericides such as sodium chlorinated isocyanurate described in Japanese Patent Application (OPI) No. 120145/1986, benzotriazole described in Japanese Patent Application No. 105487/1985, copper ion and other bactericides described in Hiroshi Horiguchi *Bokinbobai no Kagaku, Biseibutsu no Mekkin, Sakkin, Bobai Gijutsu,* edited by Eiseigijutsu kai, and *Bokinbobaizai Jiten,* edited by Nihon Bokinbobai-gakkai.

In the washing water, a surface active agent as a drainer and a chelating agent such as EDTA (ethylenediamine tetraacetate) as a water-softener can be used.

Following or without the above-described water washing step, processing by a stabilizing solution can be carried out. The stabilizing solution includes a compound having an image stabilizing function, for example an aldehyde compound represented by formalin; a buffer to adjust the film pH suitable for dye-stabilization; and an ammonium compound. An above-mentioned bactericide or fungicide can be also used to prevent the propagation of bacteria in the solution and to give a fungus-proof property to the photographic material.

Further, a surface active agent, fluorescent brightening agent, and a film-hardner can be added. In the present processing of photographic material, when stabilization is carried out directly without a washing step, all the known methods described, for example, in Japanese Patent Application (OPI) Nos. 8543/1982, 14834/1983, 184343/1984, 220345/1985, 238832/1985, 239784/1985, 239749/1985, 4054/1986, and 118749/1986 can be used.

A preferred inclusion is to use a chelating agent such as 1-hydroxyethylidene-1,1-diphosphonate, and a magnesium or bismuth compound.

The amount of stabilizing solution, as with the washing solution, can be decreased considerably (below 1 liter, more preferably below 0.5 liter) by using a multistage counter-current method. The washing water or stabilizing solution may be replenished either continuously or intermittently. If intermittently, replenishing may be done depending on the processing volume or in a certain interval of time.

The pH range of the washing or stabilizing solution in the present invention may be 4 to 10, preferably 5 to 8. The temperature, which can be set according to the use or the property of the photographic material, is generally in the range of 15° to 45° C., preferably 20° to 40° C. Although time can be set arbitrary, the effect of the present invention is remarkable with a shorter processing time, preferably 30 sec. to 2 min., more preferably 30 sec. to 1 min. 30 sec. A smaller amount of replenisher is preferable in view of the running cost, the decrease in discharge volume, ease of treatment, and the effect of the present invention.

The volume of the replenisher is 0.5 to 50 times, preferably 3 to 40 times, the carried-over volume from the preceding bath per unit area of the photographic material.

Solutions used in the washing and/or stabilizing steps can be adopted in the preceding step. For example, the volume of waste solution can be reduced by introducing the over-flowed washing water cut by the multistage counter-current method into the preceding bleach-fixing bath and by replenishing a concentrated solution into the bleach-fixing bath.

The method of this invention can be applied to any processing process using a color developing solution. For example, it can be applied to processing color paper, color reversal paper, color direct positive photosensitive material, color positive film, color negative film, or color reversal film. It is preferable for application to the processing of color paper or color reversal paper that is sensitive to contamination of stain parts.

The silver halide emulsion of the color photographic material to be use in this invention may be any type of halogen composition, including silver iodobromide, silver bromide, silver chlorobromide, or silver chloride. However, for less-replenisher processing or speedy processing a silver chlorobromide emulsion containing 80 mol% or more of silver chloride or a silver chloride emulsion is preferable, and a silver halide emulsion containing 90 to 100 mol% is especially preferable.

The silver halide crystals of the silver halide emulsion in this invention may be of such a structure that the internal phase differs from the surface phase, the entire crystals may have a uniform phase, they may be polyphase with a joining structure, or a mixture thereof.

The average size of the silver halide grains, expressed in terms of the grain diameter for spherical or semi-spherical grains and the edge length for cubic grains, can be determined as the average of the projected area diameter, etc., and it is preferably smaller than 2 $\mu$m and larger than 0.1 $\mu$m, most preferably smaller than 1.5 $\mu$m and larger than 0.15 $\mu$m.

The distribution of grain size may be either narrow or wide. A monodisperse emulsion of silver halide may be employed in the present invention. The monodisperse emulsion may have a fluctuation coefficient as a monodisperse index of 20% or less, preferably 15% or less, the coefficient of which is obtained by dividing the standard deviation calculated from the curve of the size distribution by the average particle size. In order to realize the gradation desired for the photographic material, two or more monodisperse silver halide emulsion different in grain size may be mixed in a single layer or coated as different layers that have essentially the same color sensitivity. Further, two or more polydisperse silver halide emulsions or a combination of monodisperse and polydisperse solutions can be employed as a mixture in one layer, or coated as different layers.

Silver halide grains for use in this invention may have a regular crystal structure such as cubic, hexahedral, rohmbic dodecahedral, or tetradecanhedral, an irregular crystal structure such as spherical, or a thereof composite crystal structure. Tabular grains may be employed wherein at least 50% of the total projected area of silver halide grains is tabular grains with a diameter-to-thickness ratio of about 5 to 8, particularly of about 8 or more. Silver halide emulsions may be a mixture of various crystal structures. Silver halide grains may be used which form a latent image primary on the grain surface or in the interior of the grains.

The photographic emulsion for use in this invention can be prepared by the process described in *Research Disclosure* (RD) Vol. 170 Item 17643 (I, II, III) (Dec. 1978).

Generally the emulsion to be used in this invention may be physically ripened, chemically ripened, and spectrally sensitized. Additives that will be used in these steps are described in *Research Disclosure* Vol. 176, No. 17643 (Dec. 1978) and ibid. Vol. 187, No. 18716 (Nov. 1979), and the involved sections are listed in the Table below.

Known photographic additives that can be used in this invention are also described in the above-mentioned two Research Disclosures, and the involved sections are listed in the same Table below.

| | Additive | RD 17643 | RD 18716 |
|---|---|---|---|
| 1 | Chemical sensitizer | p. 23 | p. 648 (right column) |
| 2 | Sensitivity enhancing agents | — | " |
| 3 | Spectral sensitizers | pp. 23–24 | pp. 648 (right column) –649 (right column) |
| 4 | Supersensitizers | | |
| 5 | Brightening agents | p. 24 | — |
| 6 | Antifogging agents and Stabilizers | pp. 24–25 | p. 648 (right column) |
| 7 | Couplers | p. 25 | — |
| 8 | Organic solvents | p. 25 | — |
| 9 | Light absorbers and Filter dyes | pp. 25–26 | pp. 649 (right column) –650 (right column) |
| 10 | UV absorbers | | |
| 11 | Stain preventive agents | p. 25 (right column) | p. 650 (left to right (column) |
| 12 | Image dye stabilizers | p. 25 | — |
| 13 | Hardners | p. 26 | p. 651 (left column) |
| 14 | Binders | p. 26 | " |
| 15 | Plasticizers and Lubricants | p. 27 | p. 650 (right column) |
| 16 | Coating aids and Surface active agents. | pp. 26–27 | - |
| 17 | Antistatic agents | p. 27 | " |

Various color couplers can be used in the present invention. Herein the term "color coupler" means a compound which can form dye by a coupling reaction with an oxidized aromatic primary amine developing agent. Typical and useful color couplers are naphthol or phenol compounds, pyrazolone or pyrazoloazol compounds, and open chain or heterocyclic ketomethylene compounds. Examples of these cyan, magenta and yellow couplers are disclosed in patents cited in Research Disclosure (RD) No. 17643 (Dec. 1978), VII-D and ibid. No. 18717 (Nov. 1979).

Color couplers for incorporation in the present photographic materials are preferably nondiffusible by being ballasted or polymerized. Two-equivalent couplers with a coupling-off group at the coupling-active position are more preferable than four-equivalent couplers having only hydrogen at the coupling position, in view of reduced silver coverage. Couplers can be employed in the present invention which form a dye of controlled image smearing or a colorless compound, as well as DIR couplers which release a development inhibiting reagent upon a coupling reaction, and couplers releasing a development accelerating agent.

Representative examples of yellow couplers useful in this invention include couplers of the oil-protected acylacetoamide types, as illustrated in U.S. Pat. Nos. 2,407,210, 2,875,057, and 3,265,506. Typical examples of two-equivalent yellow couplers preferable in this invention include yellow couplers having an oxygen-linked coupling-off group as illustrated in U.S. Pat. Nos. 3,408,194, 3,447,928, 3,933,501, and 4,022,620; yellow couplers having a nitrogen-linked coupling-off group as illustrated in Japanese Patent Publication No. 10739/1983, U.S. Pat. Nos. 4,401,752 and 4,326,024, *Research Disclosure* No. 18053 (April 1979), British Patent No. 1,425,020 and German Patent (OLS) Nos. 2,219,917, 2,261,361, and 2,433,812. Couplers of the α-pivaloyl-acetoanilide type are superior in the fastness of formed dye, particularly on exposure to light, while couplers of the α-benzoylacetoanilide type are capable of forming high maximum density.

Magenta couplers useful for this invention include oil-protected couplers of the indazolone or cyanoacetyl type, preferable of the 5-pyrazolone or pyrazoloazole (e.g., pyrazolotriazole) type. 5-Pyrazolones substituted by an arylamino or acylamino group at the 3-position are preferable in view of the hue and maximum densities of formed dyes, and are illustrated in U.S. Pat. Nos. 2,311,082, 2,343,703, 2,600,788, 2,908,573, 3,062,653, 3,152,896, and 3,936,015. Preferable coupling-off groups in the two-equivalent 5-pyrazolone couplers are nitrogen-linked coupling-off groups described in U.S. Pat. No. 4,310,619, and an arylthio group described in U.S. Pat. No. 4,351,897. The ballast groups described in European Patent No. 73,636 have effects to enhance developed density in the 5-pyrazolone couplers.

Examples of pyrazoloazole couplers include pyrazolobenzimidazole described in U.S. Pat. No. 3,369,897, more preferably pyrazolo 5,1-c 1,2,4 triazoles described in U.S. Pat. No. 3,725,067, pyrazolotetrazoles described in *Research Disclosure,* No. 24220 (June 1984), and pyrazolopyrazole described in *Research Disclosure,* No. 24230 (June 1984). Imidazo 1,2-b pyrazoles, described in European Patent No. 119,741, are preferable, and pyrazolo 1,5-b 1,2,4 -triazoles, described in European Patent No. 119,860, are particularly preferable with respect to the reduced. yellow side-absorption and fastness of developed dyes on exposure to light.

The cyan couplers that can be used in this invention include naphthol couplers and phenol couplers of the oil-protected type. An example of a naphthol coupler is that disclosed in U.S. Pat. No. 2,474,293, and preferred examples of naphthol couplers are such two-equivalent naphthol couplers as the oxygen atom splitting-off type disclosed in U.S. Pat. Nos. 4,052,212, 4,146,396, 4,228,233, and 4,296,200. Examples of the phenol couplers are those disclosed in U.S. Pat. Nos. 2,369,929, 2,801,171, 2,772,162, and 2,895,826.

Examples of cyan couplers stable to moisture and heat that can be advantageously used in this invention include phenol cyan couplers having a higher alkyl group than methyl group at the meta position of the phenol nucleus, as disclosed in U.S. Pat. No. 3,772,002, 2,5-diacylamino-substituted phenol cyan couplers disclosed in U.S. Pat. Nos. 2,772,162, 3,758,308, 4,126,396, 4,334,011, and 4,327,173, German Patent (OLS) 3,329,729 and Japanese Patent Publication No. 42671/1983, and phenol cyan couplers having a phenylureido group at the 2-position and an acylamino group at the 5-position disclosed in U.S. Pat. Nos. 3,446,622, 4,333,999, 4,451,559, and 4,427,767.

In the processing process of this invention, a good photographic property of less fogging can be attained by using at least one cyan coupler represented by general formula (XI) hereinbelow shown. This effect should be mentioned specially.

Formula (XI) is described in detail below.

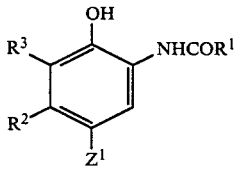

Formula (XI)

wherein $R^1$ represents an alkyl group, cycloalkyl group, aryl group, amino group, or heterocyclic group, $R^2$ represents an acylamino group or alkyl group containing more than 2 carbon atoms, $R^3$ represents a hydrogen atom, halogen atom, alkyl group, or alkoxy group, $R^3$ may form a ring by being combined with $R^2$, $Z^1$ represents a hydrogen atom, halogen atom, or group capable of splitting-off by a coupling reaction with an oxidized aromatic primary amine main color developing agent.

In formula (XI), a preferred alkyl group represented by $R^1$ is an alkyl group containing 1 to 32 carbon atoms, e.g., methyl, butyl, tridecyl, cyclohexyl and allyl; an aryl group, including a phenyl and naphthyl; and a heterocyclic group, including 2-pirizyl and 2-furyl. When $R^1$ is a amino group, a phenyl-substituted amino group which may have a further substituent is especially preferable.

$R^1$ may further be substituted by a substituent selected from a group comprising an alkyl group, aryl group, alkyl- or aryl-oxy group (e.g., methoxy, dodecyloxy, methoxyethoxy, phenyloxy, 2,4-di-tert-amylphenoxy, 3-tert-butyl-4-hydroxyphenyloxy, or naphthyloxy), carboxy group, alkyl- or aryl-carbonyl group (e.g., acethyl, tetradecanoyl, or benzoyl), alkyl- or aryloxycarbonyl group (e.g., methoxycarbonyl or phenoxycarbonyl), acyloxy group (e.g., acetyl or benzoyloxy), sulfamoyl group (e.g., N-ethylsulfamoyl or N-octadecylsulfamoyl), carbamoyl group (e.g., N-ethylcarbamoyl or N-methyldodecylcarbamoyl), sulfonamide group (e.g., mathanesulfonamido or benzenesulfonamido), acylamino group (e.g., acetylamino, benzamino, ethoxycarbonylamino or phenylaminocarbonylamino), imido group (e.g., succinimido or hydantoinyl), sulfonyl group (e.g., methanesulfonyl), hydroxyl group, cyano group, nitro group, and a halogen atom.

$Z^1$ in formula (XI) represents a hydrogen atom or a coupling-off group, e.g., a halogen atom (e.g., fluorine, chlorine, or bromine), an alkoxy group (e.g., dodecyloxy, methoxycarbamoylmethoxy, carboxypropyloxy, or methylsulfonylethoxy), an aryloxy group (e.g., acetoxy, tertradecanoyloxy, or benzoloxy), a sulfonyloxy group (e.g., methanesulfonyloxy or toluensulfonyloxy), an amido group (e.g., dichloroacetylamino, methanesulfonylamino, or toluenesulfonylamino), an alkoxycarbonyloxy group (e.g., ethoxycarbonyloxy or benzyloxycarbonyloxy), aryloxycarbonyloxy group (e.g., phenoxycarbonyloxy), an aliphatic or aromatic thio group (e.g., phenylthio or tetrazoylthio), an imido group (e.g., succinimido or hydantoinyl), N-heterocyclic ring (e.g., 1-pyrazolyl or 1-benztriazolyl), or an aromatic azo group (e.g., phenylazo). These coupling-off groups may contain a photographically useful group or groups.

$R^1$ or $R^2$ in formula (XI) may form a dimer or polymer.

Specific examples of the cyan couplers represented by the forgoing formula (XI) are illustrated below, which, however, should not be construed as limiting the scope of the present invention.

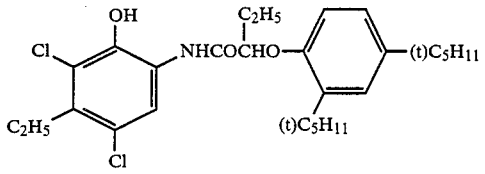

(C-1)

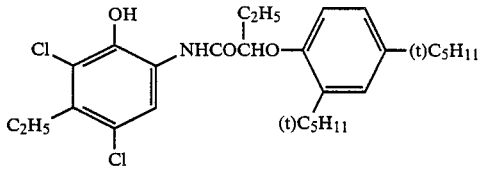

(C-2)

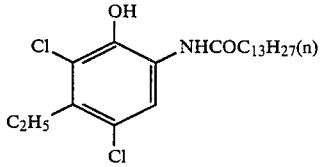

(C-3)

-continued
(C-4)
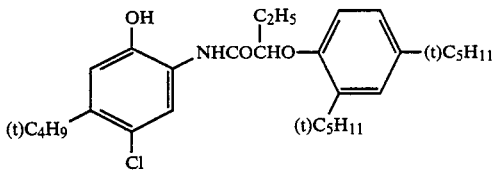
(C-5)
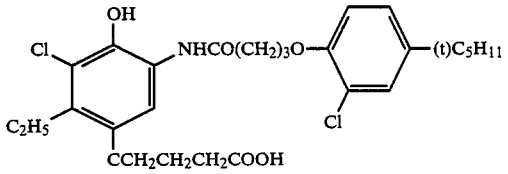
(C-6)
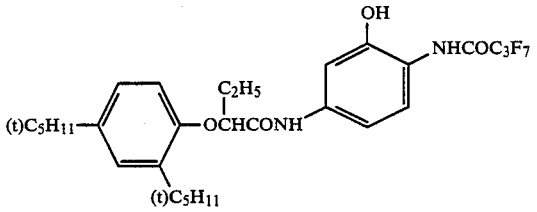
(C-7)
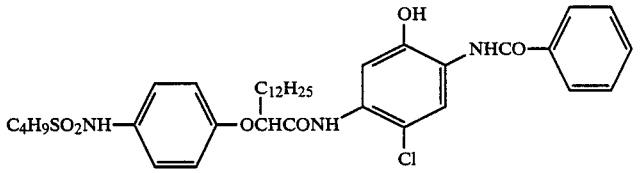
(C-8)
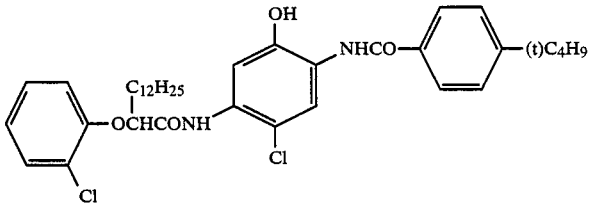
(C-9)
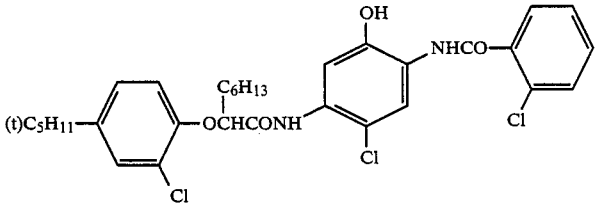
(C-10)
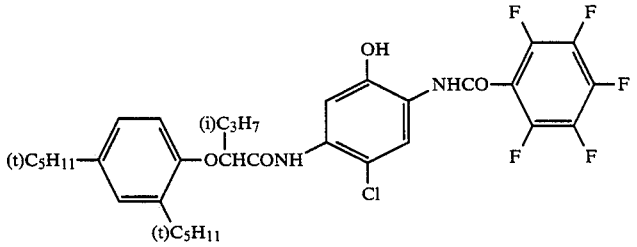

-continued
(C-11)
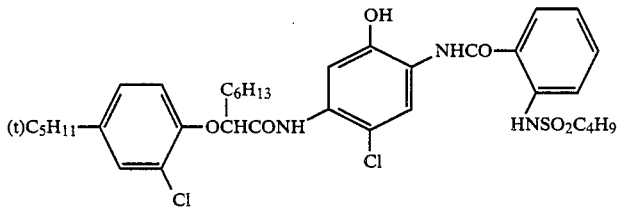
(C-12)
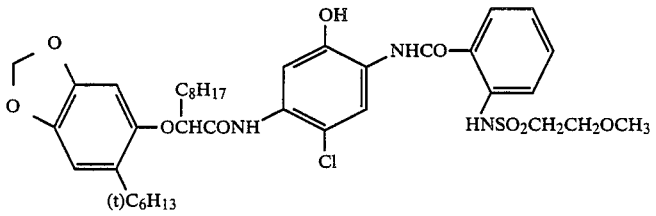
(C-13)
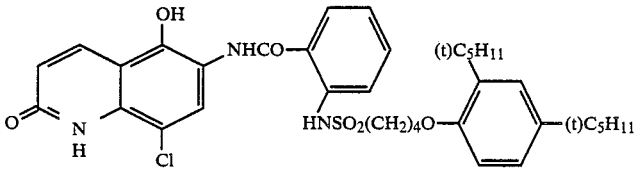
(C-14)
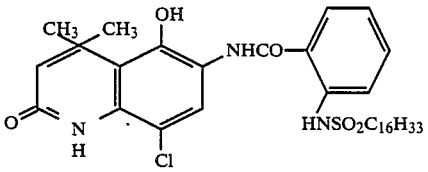
(C-15)
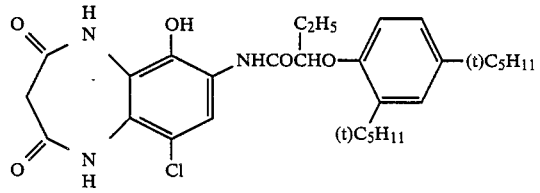
(C-16)
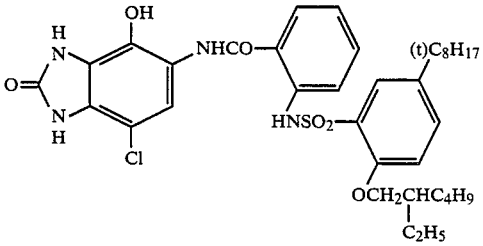
(C-17)
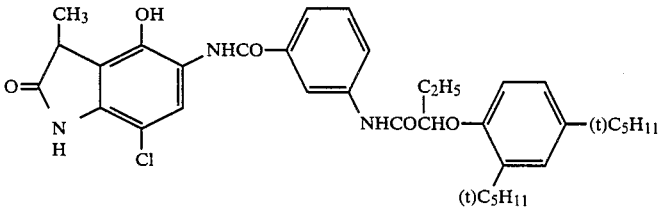

-continued
(C-18)
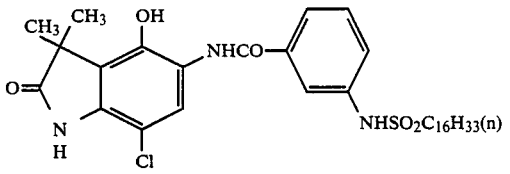
(C-19)
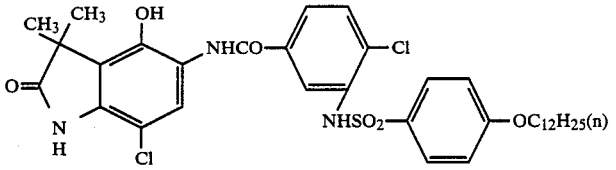
(C-20)
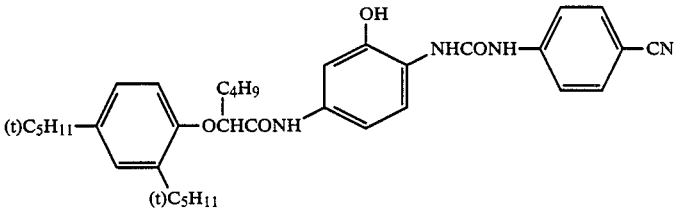
(C-21)
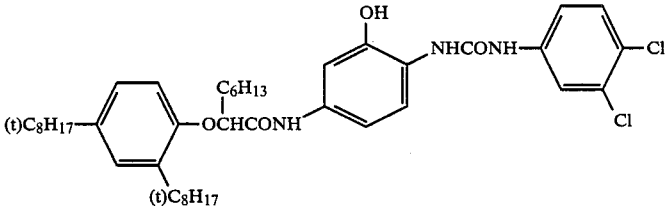
(C-22)
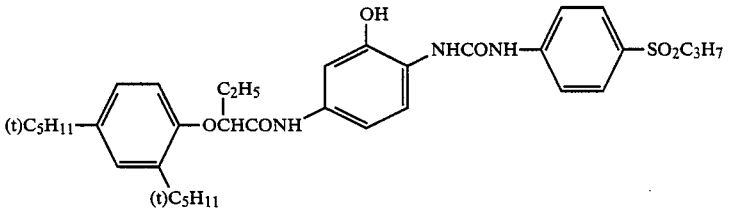
(C-23)
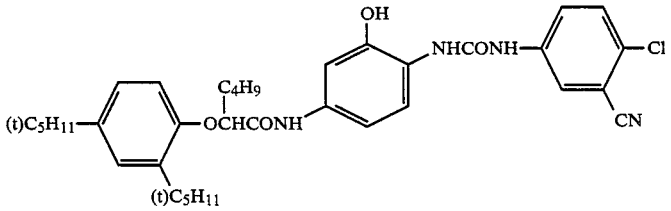
(C-24)
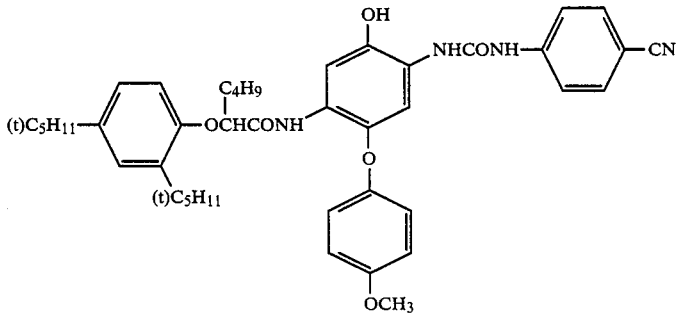

-continued (C-25)

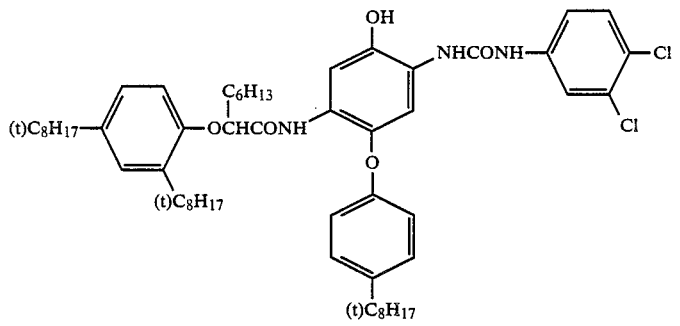

(C-26)

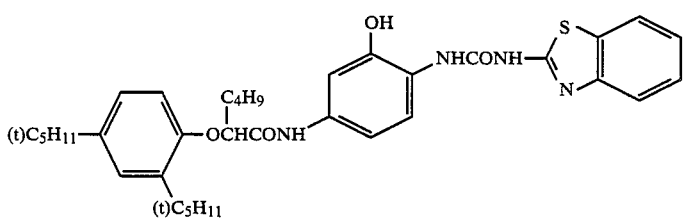

The cyan couplers represented by above-described formula (XI) can be synthesized according to the description in Japanese Patent Application (OPI) No. 166956/1984 and Japanese Patent Publication No. 11572/1974.

It is possible to improve the grainness by using color couplers in combination with a coupler which forms a dye having a proper degree of diffusion. A magenta coupler of such dye diffusing type is disclosed in U.S. Pat. No. 4,366,237 and British Patent No. 2,125,570; and a similar type of yellow, magenta, or cyan coupler is disclosed in European Patent No. 96,570 and German Patent (OLS) No. 3,234,533.

The dye-forming couplers and the special couplers described above may be dimeric, oligomeric, or polymeric. Examples of polymerized dye-forming couplers are disclosed in U.S. Pat. Nos. 3,451,820 and 4,080,211. Examples of polymerized magenta couplers are disclosed in British Patent No. 2,102,173 and U.S. Pat. No. 4,367,282.

In order to satisfy the characteristics desired for the photographic materials, various couplers used in the present invention can be employed as a combination of two or more couplers in a light-sensitive layer, or the same compound can be employed in two or more layers.

The couplers to be used in the present invention can be incorporated to photographic materials by various known dispersing processes. Examples of a high-boiling organic solvent for use in the oil-in-water dispersing process are described in U.S. Pat. No. 2,322,027. The steps and effect of the latex dispersion method and examples of latex for impregnation are described in U.S. Pat. No. 4,199,363 and German Patent Application (OLS) Nos. 2,541,274 and 2,541,230.

Couplers to be used in the present invention can be prepared by the method described in Japanese Patent Application No. 49613/1987 or International Application No. PCT/JP/87/00492. In this method at least one oil-soluble coupler which has been made nondiffusible and at least one water-insoluble and organic solvent-soluble homopolymer or copolymer are dispersed into an organic solvent to prepare a dispersion comprising lipophilic fine particles.

Although the polymers used in the preparation method described alone may be any polymers if they consist of repeating units of at least one type having no acid group on the main chain or on the side chain and they are insoluble in water but soluble in organic solvents, it is preferable to use a polymer whose repeating unit has a

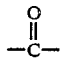

linkage in view of an improved effect on the color-forming property and the prevention of fading. On the other hand, if polymers consisting of a monomer containing an acid group are used, many are not preferable and have a lower fading prevention effect, the reason for which is not clear.

Further, in this method it is preferable to use silver halide color photographic materials wherein the repeating unit of the polymer that has no acid group has a group

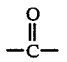

on the main chain or the side chain; or to use silver halide color photographic materials wherein the repeating unit of the polymer that has no acid group has a group

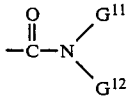

in which $G^{11}$ and $G^{12}$ each represent a hydrogen atom or a substituted or unsubstituted alkyl or aryl group on the side chain.

In the present invention these polymers are applied in such a manner as to be dissolved together with at least one oil-soluble coupler, which has been made non-diffusible, into an organic solvent to be incorporated as a dispersion of fine particles into a coating liquid. In this case as long as the polymer and the coupler are incorporated in the dispersion of fine particles, there is no particular limit on the procedure for dissolving the polymer into the organic solvent. Although there is no particular limit on the size of the fine particles of the dispersion, generally the size is 0.05 to 2.0 μm, preferably 0.05 to 1.0 μm, and more preferably 0.1 to 0.20 μm.

In this method suitable co-solvents may be used in addition to conventional high-boiling solvents to dissolve the polymers.

As co-solvents can be mentioned, for example, ethyl acetate, butyl acetate, and methyl ethyl ketone.

Although the molecular weight and polymerization degree of the polymers used in this method do not substantially influence the effect of the process, if the molecular weight becomes higher, for example, it will take much time to dissolve the polymer in a co-solvent or the polymer will have difficult, becoming emulsified and dispersed due to the high viscosity of the solution. This results in coarse particles and can cause the color developing property to be reduced and the coating properties to be defective. To overcome this, if a large amount of a co-solvent is used to lower the viscosity of the solution, other process problems will arise. Considering the above, the viscosity of the polymer is such that when 30 g of a polymer is dissolved in 100 ml of a co-solvent the viscosity becomes preferably 5000 cps or below, more preferably 2000 cps or below. Preferably the molecular weight of polymers that can be used in the present invention is 150,000 or below, more preferably 80,000 or below, and still more preferably 30,000 or below.

In this method the ratio of the polymer to the co-solvent depends on the type of the polymer used, and it can vary widely depending, for example, on the solubility of the polymer in the co-solvent, the polymerization degree of the polymer, and the solubility of the coupler. Generally a co-solvent is used in such a amount that the solution containing at least the coupler, the high-boiling coupler solvent, and the polymer in the co-solvent has a viscosity low enough to cause the solution to be readily dispersed in water or an aqueous hydrophilic colloid solution. Since the higher the degree of polymerization, the higher the viscosity of the solvent, it is difficult do determine categorically the proportion of the polymer to the co-solvent without considering the type of polymer, though it is generally preferable that the proportion be in the range of about 1:1 to 1:50 (weight ratio). The proportion of the polymer of the present invention to the coupler is preferably 1:20 to 20:1, more preferably 1:10 to 10:1 (weight ratio).

Examples of polymers may be used in the method above described are as follows:

(P-1): Poly(vinyl acetate)
(P-2): Poly(vinyl propionate)
(P-3): Poly(methyl methacrylate)
(P-4): Poly(ethyl methacrylate) (P-5): Poly(ethyl acrylate)
(P-6): Copolymer of vinyl acetate-vinyl alcohol (95:5)
(P-7): Poly(n-butyl acrylate)
(P-8): Poly(n-butyl methacrylate)
(P-9): Poly(isobutyl methacrylate)
(P-10): Poly(isopropyl methacrylate)
(P-11): Poly(octyl acrylate)
(P-12): Copolymer of n-butyl acrylate-acrylamide (95:5)
(P-13): Copolymer of stearyl methacrylate-acryl acid (95:5)
(P-14): Polyester of 1,4-butanediol-adipic acid
(P-15): Polyester of ethylene glycol-sebatic acid
(P-16): Polycaprolactone
(P-17): Polypropiolactone
(P-18): Poly dimethyl propiolactone
(P-19): Copolymer of n-butyl methacrylate-N-vinyl-2-pirrolidone (90:10)
(P-20): Copolymer of methyl methacrylate-vinyl chloride (70:30)
(P-21): Copolymer of methyl methacrylate-styrene (90:10)
(P-22): Copolymer of methyl methacrylate-ethyl acrylate (50:50)
(P-23): Copolymer of n-butyl methacrylate-methyl methacrylate - styrene (50:30:20)
(P-24): Copolymer of vinyl acetate-acrylamide (85:15)
(P-25): Copolymer of vinyl chloride-vinyl acetate (65:35)
(P-26): Copolymer of methyl methacrylate-acrylonitrile (65:35)
(P-27): Copolymer of diacetoneacrylamide-methyl methacrylate (50:50)
(P-28): Copolymer of methylvinyl ketone-isobutyl methacrylate (55:45)
(P-29): Copolymer of ethyl methacrylate-n-butyl acrylate (70:30)
(P-30): Copolymer of diacetone acrylamide-n-butyl acrylate (60:40)
(P-31): Copolymer of methyl methacrylate-styrenemethyl methaacrylate-diacetoneacryl amide (40:40:20)
(P-32): Copolymer of n-buthyl acrylate-styrene methacrylate-diacetoneacrylamide (70:20:10)
(P-33): Copolymer of stearyl methacrylate - methyl methacrylate-acrylic acid (50:40:10)
(P-34): Copolymer of methyl methacrylate-styrene-vinyl sulfonamide (70:20:10)
(P-35): Copolymer of methy methacrylate-phenylvinyl ketone (70:30)
(P-36): Copolymer of n-butyl acrylate-methyl methacrylate-n-buthyl methacrylate (35:35:30)
(P-37): Copolymer of n-buthyl methacrylate-pentyl methacrylate-N-vinyl-2-pyrrolidone (38:38:24)
(P-38): Copolymer of methyl methacrylate-n-buthyl methacrylate-isobutyl methacrylate-acrylic acid (37:29:9)
(P-39): Copolymer of n-buthyl methacrylate-acrylic acid (95:5)
(P-40): Copolymer of methyl methacrylate-acrylic acid (95:5)
(P-41): Copolymer of benzyl methacrylate-acrylic acid (95:5)
(P-42): Copolymer of n-buthyl methacrylate-methyl methacrylate-benzyl methacrylate-acrylic acid (35:35:25:5)
(P-43): Copolymer of n-butyl methacrylate-methyl methacrylate-benzyl methacrylate (35:30:30)
(P-44): Polypentyl acrylate
(P-45): Copolymer of cyclohexyl methacrylate-methyl methacrylate-n-propyl methacrylate (37:29:34)
(P-46): Poly(pentyl acrylate)
(P-47): Copolymer of methyl methacrylate-n-butyl methacrylate (65:35)
(P-48): Copolymer of vinyl acetate-vinyl propionate (75:35)

(P-49): Copolymer of n-butyl methacrylate-3-acryloxy butane-sodium 1-sulfanate (97:3)
(P-50): Copolymer of n-butyl methacrylate—methyl methacrylate—acrylamide (35:35:30)
(P-51): Copolymer of n-butyl methacrylate—methyl methacrylate—vinyl chloride (37:36:27)
(P-52): Copolymer of n-butyl methacrylate—stryene (90:10)
(P-53): Copolymer of methyl methacrylate—N-vinyl-2-pyrrolidone (90:10)
(P-54): Copolymer of n-butyl methacrylate—vinyl chloride (90:10)
(P-55): Copolymer of n-butyl methacrylate—styrene (70:30)
(P-56): Poly(N-sec-butyl acrylate)
(P-57): Poly(N-tert-butyl acrylamide)
(P-58): Copolymer of diacetoneacrylamide—methyl methacrylate (62:38)
(P-59): Poly(cyclohexyl methacrylate)
(P-60): Copolymer of N-tert-butylacrylamide—methyl methacrylate (40:70)
(P-61): Poly(N,N-dimethyl acrylamide)
(P-62): Poly(tert-butyl methacrylate)
(P-63): Copolymer of tert-butyl methacrylate—methyl methacrylate (70:30)
(P-64): Poly(N-tert-butyl methacrylamide)
(P-65): Copolymer of N-tert-butyl methacrylamide—methylphenyl methacrylate (60:40)
(P-66): Copolymer of methyl methacrylate—acrylonitrile (70:30)
(P-67): Copolymer of methyl methacrylate—methylvinyl ketone (38:72)
(P-68): Copolymer of methyl methacrylate—styrene (75:25)
(P-69): Copolymer of methyl methacrylate—hexyl methacrylate (70:30)

More specifically, the dispersion can be prepared as follows:

To yellow coupler and dye image stabilizer, ethyl acetate and solvent are added and dissolved, and the resulting solution is emulsified and dispersed in aqueous gelatin solution containing sodium dodecylbenzenesulfonate. On the other hand, a blue-sensitive sensitizing dye is added to a silver chlorobromide emulsion. The above emulsified dispersion is mixed with and dissolved in the thus-prepared blue-sensitive emulsion. In this case, polymer is dissolved in ethyl acetate. Typically the grain size of the fine particles containing yellow coupler and polymer thus dispersed in the coating solution may be about 0.05–1.0 μm and preferably 0.1–0.7 μm.

The use of this dispersing method is preferable in view of attaining further improvement of the antifading property of the color image and to prevent fluctuation in the photographic properties during the processing process.

Usually the color couplers are used in an amount of 0.001 to 1 mol per mol of photosensitive silver halides. The preferred amounts of coupler are 0.01 to 0.5 mol for yellow coupler, 0.003 to 0.3 mol for magenta coupler, and 0.02 to 0.3 mol for cyan coupler.

The photographic materials to be used in the present invention are those applied on usual flexible bases such as plastics films (e.g., cellulose nitrate, cellulose acetate, or polyethyleneterephtalate), paper, or on a rigid base such as a glass plate.

Details of the base and the method of application are described in *Research Disclosure,* Item 17643, XV (p. 27) and XVII (p. 28) (December 1978).

In this invention a reflective base may be preferably used. The "reflective base" can increase the reflectivity and make clear the dye image formed in a silver halide emulsion layer. Such a reflective base includes a based coated with a hydrophobic resin that contains a light reflecting material such as titanium oxide, zinc oxide, calcium carbonate, and calcium sulfate.

Next, the present invention will be described in detail in accordance with examples, but it should be understood that these examples are not intended to limit the scope of the present invention.

EXAMPLE 1

As a color developing solution, a processing solution having the following composition was prepared.

| Color Developing Solution | |
|---|---|
| Compound (A) [a compound having formula (I) of this invention or another] | shown in Table 1 |
| Additive compound (B) | shown in Table 1 |
| Sodium sulfite | 0.2 g |
| Pottasium carbonate | 30 g |
| Chelating agent | $1 \times 10^{-2}$ mol |
| Sodium chloride | 1.5 g |
| 4-Amino-3-methyl-N—ethyl-N—[β-methanesulfonamido)-ethyl]-aniline.sulfate | 5.0 g |
| Brightening agent (4,4'-diaminostilbene series, UVITEX-CK, made by Ciba-Geigy) | 3.0 g |
| Water | q.s. to 1000 ml |
| pH | 10.05 |

Samples (Nos. 1 to 20) of the thus-prepared color developing solutions were poured into test tubes so that an opening ratio (opening area/sample area) might be 0.03 $cm^{-1}$, and they were allowed to stand at 35° C. for 6 weeks. Afterward the evaporated contents were compensated for with distilled water, and the residual ratio of an aromatic primary amine color developing agent was measured by liquid chromatography and then calculated.

The results are set forth in Table 1.

TABLE 1

| Sample No. | Compound A*1 (0.03 mol/l) | Additive Compound B (0.04 mol/l) | Chelating*2 Agent | Residual*3 Ratio (%) of Developing Agent | Remarks |
|---|---|---|---|---|---|
| 1 | — | Diethylhydroxylamine | (57) | 66 | Comp. Example |
| 2 | — | " | (68) | 68 | " |
| 3 | I-(1) | " | Ethylenediaminetetraacetic acid | 71 | " |
| 4 | Triethanolamine | " | (68) | 70 | " |

TABLE 1-continued

| Sample No. | Compound A*1 (0.03 mol/l) | Additive Compound B (0.04 mol/l) | Chelating*2 Agent | Residual*3 Ratio (%) of Developing Agent | Remarks |
|---|---|---|---|---|---|
| 5 | — | " | Ethylene-diaminetetra-acetic acid | 65 | " |
| 6 | I—(1) | " | (4) | 89 | This invention |
| 7 | " | " | (26) | 91 | " |
| 8 | " | " | (33) | 90 | " |
| 9 | " | " | (49) | 93 | " |
| 10 | " | " | (57) | 92 | " |
| 11 | " | " | (68) | 96 | " |
| 12 | " | Hydroxylamine, sulfate | (68) | 95 | " |
| 13 | " | N,N—dimethyl-hydrazine | (68) | 97 | " |
| 14 | " | Glucose | (68) | 93 | " |
| 15 | " | Phenylhydrazide | (68) | 97 | " |
| 16 | I—(2) | Diethylhydroxyl-amine | (68) | 94 | " |
| 17 | I—(6) | " | (68) | 93 | " |
| 18 | I—(9) | " | (68) | 93 | " |
| 19 | I—(16) | " | (68) | 94 | " |
| 20 | I—(9) | Hydroxylamine, sulfate | (57) | 90 | " |

*1It was represented with each number of the exemplified compounds mentioned above.
*2It was represented with each number of the exemplified compounds mentioned above.
*3The residual ratio (%) of the developing agent = (concentration of the residual developing agent) / (5.0 g/l) × 100

As is apparent from the results in Table 1, the functional effect of chelating agents unconcerned with this invention is insufficient, even when compounds having formula (I) are added (Sample Nos. 3 and 5), and even when the chelating agents regarding this invention are employed. The effect is also poor when compounds other than those of formula (I) are added (Sample Nos. 2 and 4).

On the contrary, the color developing solutions on the basis of this invention are remarkably improved in stability.

EXAMPLE 2

A multi-layer color photographic paper was prepared which has such layers as hereinbelow described on a paper laminated on both sides with polyethylene. Coating solutions were prepared as follows:

PREPARATION OF THE FIRST LAYER COATING SOLUTION

To a mixture of 19.1 g of a yellow coupler (ExY) and 4.4 g of an image dye stabilizer (Cpd-1) were added 27.2 ml of ethyl acetate and 7.7 ml of a solvent (Solv-1), and they were then dissolved. Afterward, the resulting solution was emulsified and dispersed in 185 ml of a 10% aqueous gelatin solution containing 8 ml of 10% sodium dodecylbenzenesulfonate. On the other hand, the undermentioned blue-sensitive sensitizing dye was added to a silver chlorobromide emulsion (containing 1.0 mol% of silver bromide and 70 g/kg of Ag), the amount being $5.0\times10^{-4}$ mol per mol of silver chlorobromide. This blue-sensitive emulsion was mixed with and dissolved in the above emulsified and dispersed solution so as to obtain the composition shown below, thereby constituting the desired first coating solution.

The second to seventh layer coating solutions were prepared in the same manner as the first. As a gelatin hardner for the respective layers, 1-oxy-3,5-dichloro-s-triadine sodium salt was used.

Further, as spectral sensitizers for the respective emulsions, the following materials were used.

Blue-sensitive emulsion layer

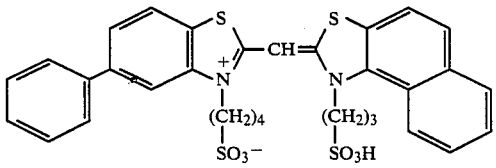

($5.0 \times 10^{-4}$ mol per mol of a silver halide)

Green-sensitive emulsion layer

-continued

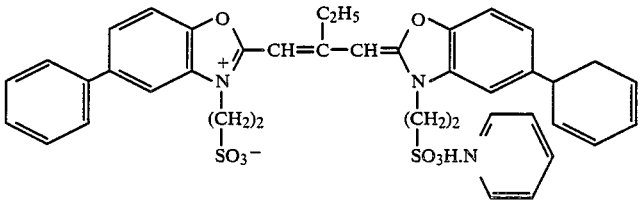

($4.0 \times 10^{-4}$ mol per mol of a silver halide) and

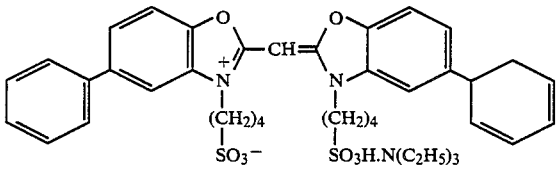

($7.0 \times 10^{-5}$ mol per mol of a silver halide)

Red-sensitive emulsion

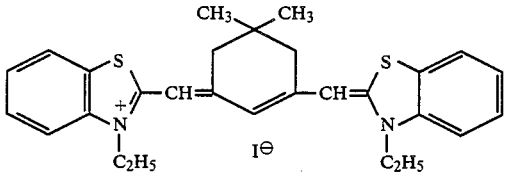

($0.9 \times 10 \times 10^{-4}$ mol per mol of a silver halide)

The following compound was added to the red-sensitive emulsion layer in amount of $2.6 \times 10^{-3}$ mol per mol of a silver halide.

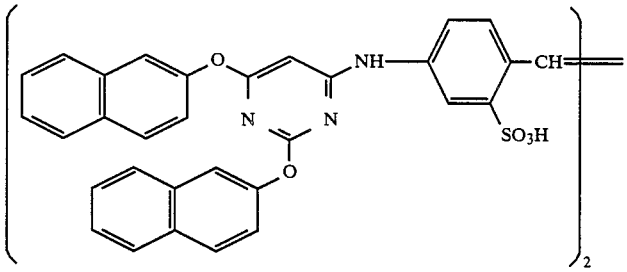

Further, 1-(5-methylureidophenyl)-5-mercaptotetrazole was added to the blue-sensitive emulsion layer, the green-sensitive emulsion layer and the red-sensitive emulsion layer in amounts of $8.5 \times 10^{-5}$ mol, $7.7 \times 10^{-4}$ mol and $2.5 \times 10^{-4}$ mol per mol of a silver halide, respectively.

The following dyes were added to prevent the respective emulsion layers for irradiation.

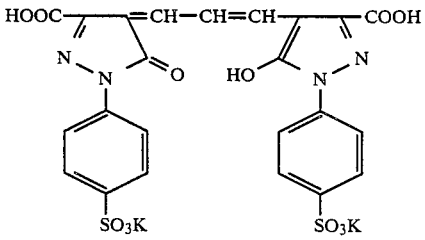

and

-continued

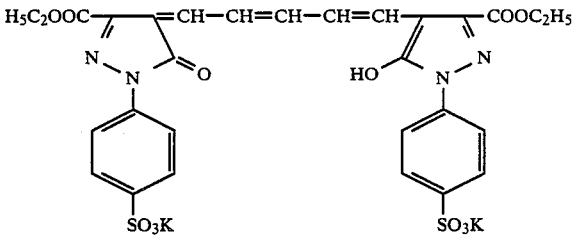

COMPOSITION OF LAYERS

The composition of each layer is shown below. Each ingredient is indicated in g/m$^2$ of a coating amount, but the coating amount of silver halide emulsion is shown in g/m$^2$ in terms of silver.

| | |
|---|---|
| Supporting base | |
| Polyethylene laminated paper a white pigment, $TiO_2$ and bluish dye, ultramarine, were included in the first layer side of the polyethylene film laminated). | |
| First layer: Blue-sensitive layer | |
| Silver chlorobromide emulsion (Br: 1 mol%) | 0.30 |
| Gelatin | 1.86 |
| Yellow coupler (ExY) | 0.82 |
| Image dy stabilizer (Cpd-1) | 0.19 |
| Solvent (Solv-1) | 0.35 |
| Second layer: Color mix preventing layer | |
| Gelatin | 0.99 |
| Color mix inhibitor (Cpd-2) | 0.08 |
| Third layer: Green-sensitive layer | |
| Silver chlorobromide emulsion (Br: 1 mol%) | 0.36 |
| Gelatin | 1.24 |
| Magenta coupler (ExM) | 0.31 |
| Image dye stablizier (Cpd-3) | 0.25 |
| Image dye stabilizer (Cpd-4) | 0.12 |
| Solvent (Solv-2) | 0.42 |
| Fourth layer: UV absorbing layer | |
| Gelatin | 1.58 |
| UV absorbent (UV-1) | 0.62 |
| Color mix inhibitor (Cpd-5) | 0.05 |
| Solvent (Solv-3) | 0.24 |
| Fifth layer: Red-sensitive emulsion layer | |
| Silver chlorobromide emulsion (Br: 1 mol%) | 0.23 |
| Gelatin | 1.34 |
| Cyan coupler (ExC) | 0.34 |
| Image dye stabilizer (Cpd-6) | 0.17 |
| Polymer (Cpd-7) | 0.40 |
| Solvent (Solv-4) | 0.23 |
| Sixth layer: UV absorbing layer | |
| Gelatin | 0.53 |
| UV absorbent (UV-1) | 0.21 |
| Solvent (Solv-3) | 0.08 |
| Seventh layer: Protective layer | |
| Gelatin | 1.33 |
| Acryl-modified copolymer of polyvinyl alcohol (modification degree: 17%) | 0.17 |
| Liquid paraffin | 0.03 |

(ExY) Yellow coupler

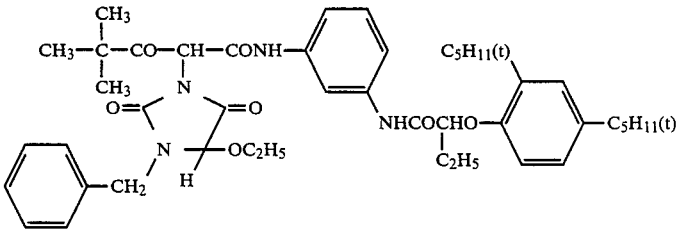

(ExM) Magenta coupler

-continued
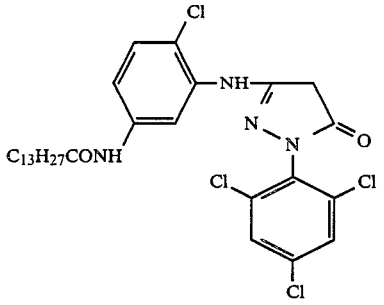
(ExC) Cyan coupler (mixture in molar ratio of 1:1)
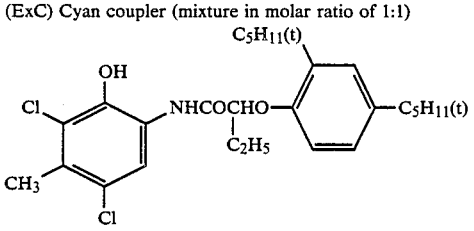
and
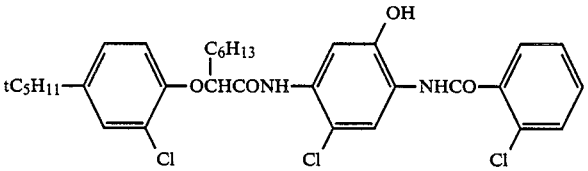
(Cpd-1) Image dye stabilizer
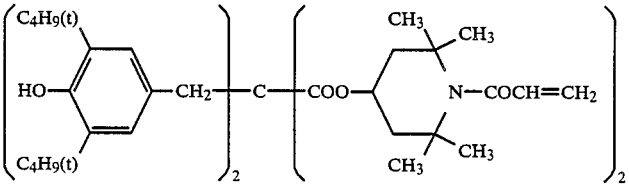
(Cpd-2) Color mix inhibitor
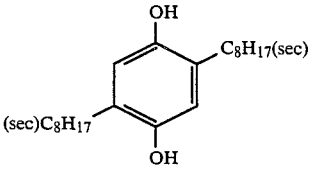
(Cpd-3) Image dye stabilizer
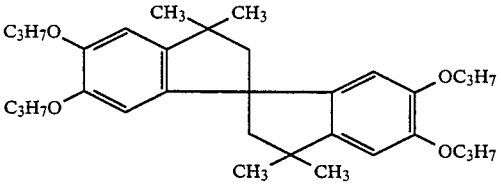
(Cpd-4) Image dye stabilizer
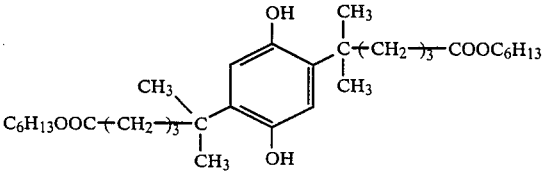
(Cpd-5) Color mix inhibitor -continued
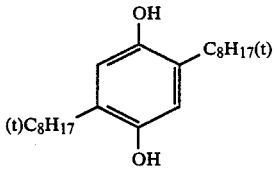
(Cpd-6) Image dye stabilizer (mixture in weight ratio of 5:8:9)
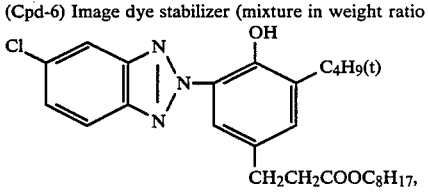
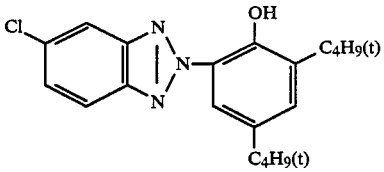
and
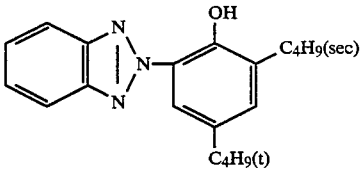
(Cpd-7) Polymer
$$\left(CH_2-\underset{\underset{CONHC_4H_9(t)}{|}}{CH}\right)_n$$
(Average molecular weight: 80,000)
(UV-1) UV absorbent (mixture in weight ratio of 2:9:8)
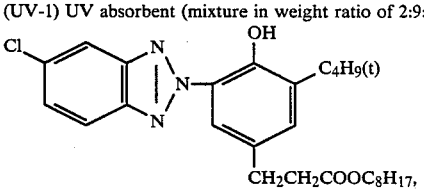
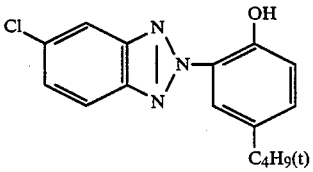
and
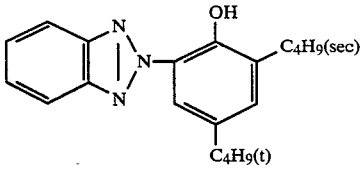
(Solv-1) Solvent
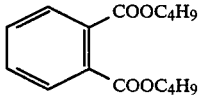
(Solv-2) Solvent (mixture in volum ratio of 1:1)

-continued

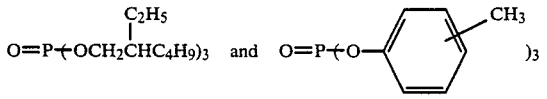

(Solv-3) Solvent $O{=}P{\leftarrow}O{-}C_9H_{19}(iso))_3$ (Solv-4) Solvent

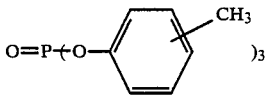

The obtained color photographic paper was exposed through an optical wedge and then processed through the following processing steps:

| Processing Step | Temperature | Time |
|---|---|---|
| Color Development | 35° C. | 45 seconds |
| Bleach-fixing | 35° C. | 45 seconds |
| Rinsing 1 | 35° C. | 20 seconds |
| Rinsing 2 | 35° C. | 20 seconds |
| Rinsing 3 | 35° C. | 20 seconds |
| Rinsing 4 | 35° C. | 30 seconds |
| Drying | 70–80° C. | 60 seconds |

The rinsing solutions were used in a four-tank counter-current washing system from the above rinsing 4 to rinsing 1. Processing solutions which were used in the above steps were as follows:

| | |
|---|---|
| Color Developing Solution | |
| Compound having general formula (I) or another (see Table 2) | $4 \times 10^{-2}$ mol |
| Chelating Agent (a compound of this invention or another) (see Table 2) | $1 \times 10^{-2}$ mol |
| Benzyl alcohol | (see Table 2) |
| Diethylene glycol | (see Table 2) |
| Sodium sulfite | 0.2 g |
| Potassium carbonate | 30 g |
| Diethylenehydroxylamine | 4.5 g |
| Sodium chloride | 1.5 g |
| Color developing agent (see Table 2) | 0.01 mol |
| Brightening agent (UVITEX CK., made by Ciba-Geigy) | 3.0 g |
| Water | q.s. to 1000 ml |
| pH | 10.05 |
| Bleach-fixing Solution | |
| EDTA $Fe(III)NH_4.2H_2O$ | 60 g |

-continued

| | |
|---|---|
| EDTA.2Na.$2H_2O$ | 4 g |
| Ammonium thiosulfate (70%) | 120 ml |
| Sodium sulfite | 16 g |
| Ammonium bromide | 30 g |
| Glacial acetic acid | 7 g |
| Water | q.s. to 1000 ml |
| pH | 5.5 |
| Rinsing Solution | |
| Ion-exchanged water (each content of calcium and magnesium was 3 ppm or less) | |

On the other hand, a part of the above-mentioned color developing solution was allowed to stand in an open system in a 1-liter beaker at 40° C. for 14 days, after which it was processed by the above-mentioned processing steps (in this case the evaporated contents were compensated).

The processing using the color developing solution which had been allowed to stand for 14 days ("stood" solution) would be called a stood solution test, and the processing of using the color developing solution which had not been allowed to stand ("fresh" solution) would be called a fresh solution test.

Photograhic characteristics obtained through the fresh solution test and the stood solution test are set forth in Table 2.

The photographic characteristics were represented with 2 points of Dmin and the gradation of magenta concentration.

The Dmin was indicative of the minimum concentration, and the gradations denoted by the concentration change between a point of a concentration of 0.5 to a point of concentration corresponding to a point higher on the exposure side of 0.3 in terms of logE.

TABLE 2

| Test No. | Color* Developing Agent | Benzyl Alcohol/ Diethylene Glycol (ml/ml) | Compound of general formula (I) or Other (0.04 mol/l) | Chelating Agent (0.01 mol/l) | Fresh solution Dmin | Fresh solution Gradation | Stood solution Dmin | Stood solution Gradation | Remarks |
|---|---|---|---|---|---|---|---|---|---|
| 1 | H | 15/10 | I-(1) | Ethylene-diaminetetra-acetic acid | 0.14 | 0.75 | 0.24 | 0.86 | Comparative Example |
| 2 | " | — | I-(1) | " | 0.13 | 0.71 | 0.22 | 0.83 | " |
| 3 | " | — | I-(1) | Nitrilotri-acetic acid | 0.13 | 0.71 | 0.21 | 0.82 | " |
| 4 | " | — | Triethanol | (68) | 0.13 | 0.71 | 0.26 | 0.56 | " |
| 5 | E | — | I-(1) | (68) | 0.13 | 0.74 | 0.16 | 0.79 | This invention |
| 6 | F | — | " | " | 0.13 | 0.73 | 0.17 | 0.79 | " |
| 7 | G | — | " | " | 0.13 0.73<br>0.16 0.78 | " | | | |
| 8 | H | — | " | " | 0.13 0.71<br>0.14 0.72 | " | | | |

TABLE 2-continued

| Test No. | Color* Developing Agent | Benzyl Alcohol/ Diethylene Glycol (ml/ml) | Compound of general formula (I) or Other (0.04 mol/l) | Chelating Agent (0.01 mol/l) | Fresh solution Dmin | Fresh solution Gradation | Stood solution Dmin | Stood solution Gradation | Remarks |
|---|---|---|---|---|---|---|---|---|---|
| 9 | " | 15/10 | " | " | 0.14 | 0.75 | 0.17 | 0.81 | " |
| 10 | " | — | " | (4) | 0.13 | 0.71 | 0.15 | 0.74 | " |
| 11 | " | — | " | (10) | 0.13 | 0.71 | 0.15 | 0.73 | " |
| 12 | " | — | " | (25) | 0.13 | 0.71 | 0.14 | 0.73 | " |
| 13 | " | — | " | (26) | 0.13 | 0.71 | 0.16 | 0.74 | " |
| 14 | " | — | " | (48) | 0.13 | 0.71 | 0.15 | 0.73 | " |
| 15 | " | — | " | (56) | 0.13 | 0.71 | 0.16 | 0.73 | " |
| 16 | " | — | " | (57) | 0.13 | 0.71 | 0.15 | 0.75 | " |
| 17 | " | — | " | (58) | 0.13 | 0.71 | 0.15 | 0.75 | " |
| 18 | " | — | I-(2) | (68) | 0.13 | 0.72 | 0.16 | 0.74 | " |
| 19 | " | — | I-(6) | " | 0.13 | 0.71 | 0.16 | 0.74 | " |
| 20 | " | — | I-(9) | " | 0.13 | 0.73 | 0.15 | 0.76 | " |
| 21 | " | — | I-(16) | " | 0.13 | 0.72 | 0.15 | 0.77 | " |

*Color developing agents are as follows:

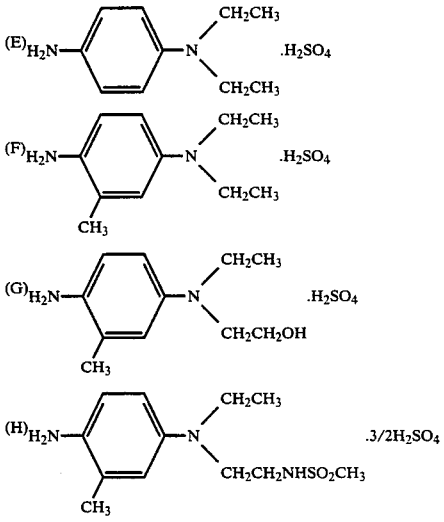

According to the results shown in Table 2 regarding the samples of Test Nos. 1 to 4, the Dmin and the gradation change over time, so that high contrast occurs. On the contrary, when the compounds of this invention are used the photographic characteristics of the processing solutions are fairly inhibited from changing over time (Test Nos. 5 to 21), and this effect is particularly significant in that no benzyl alcohol is contained therein and that the color developing agent is the compound (H).

EXAMPLE 3

A multi-layer color photographic paper was prepared which has such layers as hereinbelow described on a paper laminated on both sides with polyethylene. Coating solutions were prepared as follows:

PREPARATION OF THE FIRST LAYER COATING SOLUTION

The same procedure as in Example 2 was repeated with the exception of using an image dye stabilizer (Cpd) and a silver chlorobromide emulsion containing 80.0 mol% of silver bromide and 70 g/kg of Ag.

As spectral sensitizers for the respective emulsions, the following materials were used.

Blue-sensitive emulsion layer

-continued

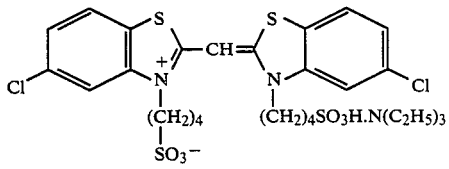

($5.0 \times 10^{-4}$ mol per mol of a silver halide)

Green-sensitive emulsion layer

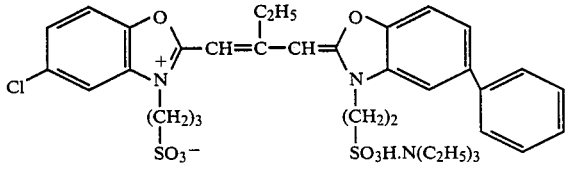

($4.0 \times 10^{-4}$ mol per mol of a silver halide)

and

-continued

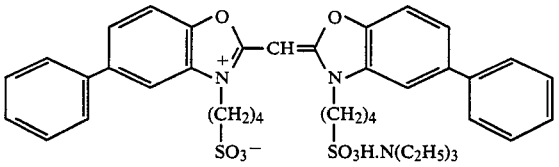

($7.0 \times 10^{-5}$ mol per mol of a silver halide)

Red-sensitive emulsion layer

The same compounds as Example 2 were used.

Further, 1-(5-methylureidophenyl)-5-mercaptotetrazole was added to the blue-sensitive emulsion layer, the green-sensitive emulsion layer, and the red-sensitive emulsion layer in amounts of $4.0\times10^{-6}$ mol, $3.0\times10^{-5}$ mol and $1.0\times10^{-5}$ mol per mol of a silver halide, respectively.

Furthermore, 4-hydroxy-6-methyl-1,3,3a,7-tetrazaindene was added to the blue-sensitive emulsion layer and the green-sensitive emulsion layer in amounts of $1.2\times10^{-2}$ mol and $1.1\times10^{-2}$ mol per mol of a silver halide, respectively.

The following dyes were added to the emulsion layers to prevent irradiation:

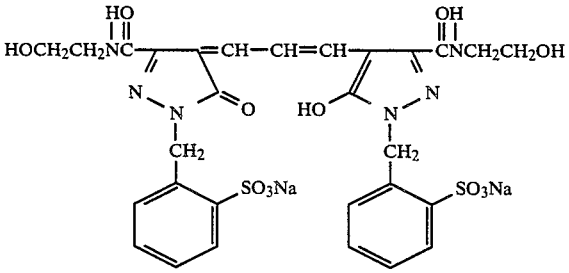

and

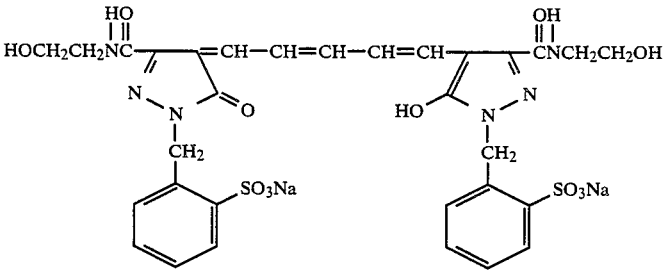

COMPOSITION OF LAYERS

The composition of each layer is shown below. The figures represent coating amounts (g/m²). The coating amount of each silver halide emulsion is represented in terms of silver.

| | |
|---|---|
| Supporting Base | |
| Same as Example 2 | |
| First Layer: Blue-sensitive layer | |
| Silver halide emulsion (Br: 80%) | 0.26 |
| Gelatin | 1.83 |
| Yellow coupler (ExY) | 0.83 |
| Image dye stabilizer (Cpd-1) | 0.19 |
| Solvent (Solv-1) | 0.35 |
| Second Layer: Color mix inhibiting layer | |

-continued

| | |
|---|---|
| Same as Example 2 | |
| Third Layer: Green-sensitive layer | |
| Silver halide emulsion (Br: 80%) | 0.16 |
| Gelatin | 1.79 |
| Magenta coupler (ExM) | 0.32 |
| Image dye stabilizer (Cpd-3) | 0.20 |
| Image dye stabilizer (Cpd-4) | 0.01 |
| Solvent (Solv-2) | 0.65 |
| Fourth Layer: UV absorbing layer | |
| Same as Example 2 | |
| Fifth Layer: Red-sensitive layer | |
| Silver halide emulsion (Br: 70%) | 0.23 |
| Gelatin | 1.34 |
| Cyan coupler (ExC) | 0.34 |
| Image dye stabilizer (Cpd-6) | 0.17 |
| Polymer (Cpd-7) | 0.40 |
| Solvent (Solv-4) | 0.23 |
| Sixth Layer: UV absorbing layer | |
| Same as Example 2 | |
| Seventh Layer: Protective layer | |
| Same as Example 2 | |
| (ExY) Yellow coupler | |
| Same as Example 2 | |

(ExM) Magenta coupler

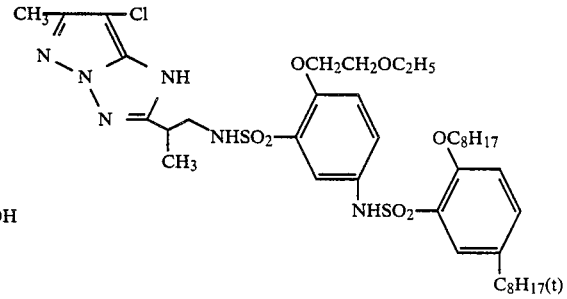

(ExC) Cyan coupler

-continued

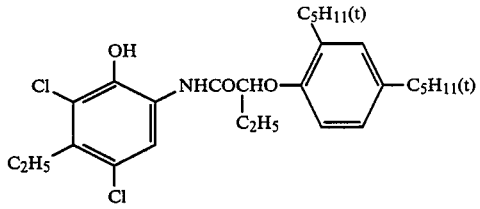

(Cpd-1) Image dye stabilizer, (Cpd-2) Color mix inhibitor and (Cpd-3) Image dye stabilizer
Same as Example 2

(Cpd-4) Image dye stabilizer

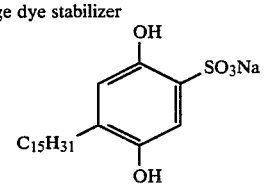

(Cpd-5) Color mix inhibitor, (Cpd-6) Image dye stabilizer, (Cpd-7) Polymer, (UV-1) UV absorbent and (Solv-1) Solvent
Same as Example 2

(Solv-2) Solvent

-continued

Same as Example 2

After exposed to light imagewise, the above-mentioned photographic material was subjected to a running test, altering the composition of the color developing solution and replenisher amount of the rinsing solution, until the color developing solution twice as much as the volume of a tank had been replenished.

| Processing Step | Temp. | Time | Replenisher Amount (ml/m²) |
|---|---|---|---|
| Color development | 38° C. | 1 min 40 sec | 290 |
| Bleach-fix | 30–40° C. | 1 min | 150 |
| Rinsing 1 | 30–34° C. | 20 sec | — |
| Rinsing 2 | 30–34° C. | 20 sec | — |
| Rinsing 3 | 30–34° C. | 20 sec | see Table 3 |
| Drying | 70–80° C. | 50 sec | — |

A 3-tank counter flow washing system from the above rinsing 3 to rinsing 1 was employed.

The feed of the above-mentioned bath was 30 ml per square meter of the photographic material. Composition of each processing solution was as follows:

| Color Developing Solution | Tank solution | Replenisher |
|---|---|---|
| Chelating agent (see Table 3) | $1 \times 10^{-2}$ mol | $1 \times 10^{-2}$ mol |
| Additive (a compound of general formula (I) or another) | $4 \times 10^{-2}$ mol | $4 \times 10^{-2}$ mol |
| Potassium bromide | 0.5 g | — |
| Potassium carbonate | 30 g | 30 g |
| N—Ethyl-N—(β-methanesulfonamidoethyl)-3-methyl-4-aminoaniline sulfate | 5.5 g | 7.5 g |
| Hydroxylamine sulfate | 3.0 g | 4.7 g |
| Fluorescent brightening agent (UVITEX CK., made by Ciba-Geigy) | 2.0 g | 4.0 g |
| Water | q.s. to 1000 ml | 1000 ml |
| pH (25° C.) | 10.25 | 10.60 |
| **Bleach-fixing Solution** | **Tank solution** | **Replenisher** |
| Water | 400 ml | 400 ml |
| Ammonium thiosulfate (70%) | 200 ml | 400 ml |
| Sodium sulfite | 20 g | 40 g |
| Iron (III) ammonium ethylenediaminetetraacetate | 60 g | 120 g |
| Disodium ethylenediaminetetraacetate | 10 g | 20 g |
| Water | q.s. to 1000 ml | 1000 ml |
| pH (25° C.) | 7.00 | 6.30 |
| **Rinsing Solution** | | |
| (Same tank solution and replenisher) Ion-exchanged water (each content of calcium and magnesium was 3 ppm or less) | | |

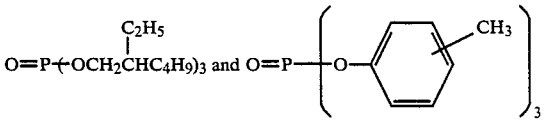

(mixture in volume ratio of 2:1)
(Solv-3) Solvent and (Solv-4) Solvent

In the above-mentioned processing, measurements were made by a Macbeth illuminometer to obtain values of Dmin in the respective processing steps, values of the Dmin after standing at 60° C. at 70% RH for 1 month, and the concentration drop of magenta after standing under a xenon arc of 80,000 lux for 15 days. The results are set forth in Table 3.

TABLE 3

| Test No. | Replenisher Amount of Rinsing solution (ml/m²) | Ratio to Carried-over Amount | Chelating Agent | Additive | Remarks | Dmin Just after processing B | G | R | Dmin after elapse of time B | G | R | Density of Magenta (at D = 20) |
|---|---|---|---|---|---|---|---|---|---|---|---|---|
| 1 | 12 | 0.4 | (68) | Tri- | Com- | 0.25 | 0.20 | 0.16 | 0.41 | 0.29 | 0.24 | 1.40 |

TABLE 3-continued

| Test No. | Replenisher Amount of Rinsing solution (ml/m²) | Ratio to Carried-over Amount | Chelating Agent | Additive | Remarks | Dmin Just after processing B | G | R | Dmin after elapse of time B | G | R | Density of Magenta (at D = 20) |
|---|---|---|---|---|---|---|---|---|---|---|---|---|
| | | | | ethanol-amine | parative Example | | | | | | | |
| 2 | 300 | 10 | (68) | " | " | 0.18 | 0.17 | 0.15 | 0.33 | 0.26 | 0.23 | 1.49 |
| 3 | 300 | 10 | (68) | Poly-ethylene-imine | " | 0.19 | 0.17 | 0.14 | 0.34 | 0.26 | 0.21 | 1.51 |
| 4 | 300 | 10 | Ethylene-diamine-tetraacetic acid | 1-(1) | " | 0.20 | 0.19 | 0.15 | 0.35 | 0.25 | 0.22 | 1.50 |
| 5 | 300 | 10 | Nitrilo-triacetic acid | 1-(1) | " | 0.19 | 0.18 | 0.14 | 0.35 | 0.25 | 0.21 | 1.50 |
| 6 | 300 | 10 | Ethylene-triamine-hexaacetic acid | 1-(1) | " | 0.18 | 0.16 | 0.14 | 0.36 | 0.24 | 0.22 | 1.50 |
| 7 | 3000 | 100 | (68) | Tri-ethanol-amine | " | 0.17 | 0.16 | 0.13 | 0.35 | 0.25 | 0.21 | 1.45 |
| 8 | 12 | 0.4 | (68) | 1-(1) | This in-vention | 0.14 | 0.15 | 0.12 | 0.27 | 0.20 | 0.15 | 1.65 |
| 9 | 90 | 3 | " | " | " | 0.12 | 0.13 | 0.10 | 0.23 | 0.19 | 0.14 | 1.85 |
| 10 | 300 | 10 | " | " | " | 0.11 | 0.13 | 0.10 | 0.22 | 0.18 | 0.13 | 1.90 |
| 11 | 600 | 20 | " | " | " | 0.10 | 0.13 | 0.10 | 0.22 | 0.18 | 0.13 | 1.91 |
| 12 | 1200 | 40 | " | " | " | 0.10 | 0.13 | 0.10 | 0.22 | 0.18 | 0.13 | 1.85 |
| 13 | 3000 | 100 | " | " | " | 0.10 | 0.13 | 0.10 | 0.22 | 0.18 | 0.13 | 1.70 |
| 14 | 90 | 3 | (57) | " | " | 0.11 | 0.13 | 0.10 | 0.23 | 0.19 | 0.14 | 1.81 |
| 15 | 300 | 10 | " | " | " | 0.11 | 0.13 | 0.10 | 0.23 | 0.18 | 0.14 | 1.81 |
| 16 | 600 | 20 | " | " | " | 0.11 | 0.13 | 0.10 | 0.23 | 0.18 | 0.14 | 1.83 |
| 17 | 90 | 3 | " | 1-(2) | " | 0.11 | 0.14 | 0.10 | 0.24 | 0.19 | 0.14 | 1.83 |
| 18 | 300 | 10 | " | " | " | 0.11 | 0.14 | 0.10 | 0.23 | 0.18 | 0.14 | 1.80 |
| 19 | 600 | 60 | " | " | " | 0.11 | 0.14 | 0.10 | 0.23 | 0.18 | 0.14 | 1.80 |

TABLE B

| Layer | Main Component | |
|---|---|---|
| Seventh Layer (protective layer) | Gelatain | 600 mg/m² |
| Sixth Layer (UV absorbing layer) | UV Absorbent (n) | 260 mg/m² |
| | UV Absorbent (o) | 70 mg/m² |
| | Solvent (p) | 300 mg/m² |
| | Solvent (q) | 100 mg/m² |
| | Gelatin | 700 mg/m² |
| Fifth Layer (red-sensitive layer) | Silver Chlorobromide Emulsion (silver bromide 70 mol% | 210 mg/m² |
| | Cyan Coupler (See Table 4) | $5 \times 10^{-4}$ mol/m² |
| | Discoloration Inhibitor (r) | 250 mg/m² |
| | Solvent (p) | 160 mg/m² |
| | Solvent (q) | 100 mg/m² |
| | Gelatin | 1800 mg/m² |
| Fourth Layer (color mix inhibiting layer) | Color Mix Inhibitor (s) | 65 mg/m² |
| | UV Absorbent (n) | 450 mg/m² |
| | UV Absorbent (o) | 230 mg/m² |
| | Solvent (p) | 50 mg/m² |
| | Solvent (q) | 50 mg/m² |
| | Gelatin | 1700 mg/m² |
| Third Layer (green-sensitive layer) | Silver Chlorobromide Emulsion (silver bromide 75 mol %) | 305 mg/m² |
| | Magenta Coupler | 670 mg/m² |
| | Discoloration Inhibitor (t) | 150 mg/m² |
| | Discoloration Inhibitor (u) | 10 mg/m² |
| | Solvent (p) | 200 mg/m² |
| | Solvent (q) | 10 mg/m² |
| | Gelatin | 1400 mg/m² |
| Second Layer (discoloration inhibiting layer) | Silver Bromide Emulsion (no after-ripening, grain diameter 0.05 microns) | Silver : 10 mg/m² |
| | Discoloration Inhibitor (s) | 55 mg/m² |
| | Solvent (p) | 30 mg/m² |
| | Solvent (q) | 15 mg/m² |
| | Gelatin | 800 mg/m² |
| First Layer blue-sensitive layer) | Silver chlorobromide Emulsion (silver bromide 80 mol %) | 290 mg/m² |
| | Yellow Coupler | 600 mg/m² |

TABLE B-continued

| Layer | Main Component | |
|---|---|---|
| | Discoloration Inhibitor (r) | 280 mg/m$^2$ |
| | Solvent (p) | 30 mg/m$^2$ |
| | Solvent (q) | 15 mg/m$^2$ |
| | Gelatin | 1800 mg/m$^2$ |
| Base | Paper, both surfaces of which were laminated with polyethylene | |

According to this invention, there can be obtained the preferable results that stains on the samples are imperceptible after the processing and after a predetermined period of standing, and the light stability of the magenta is improved noticeably as long as the amount of the replenished rinsing solution is within a range of 3 to 40 times as much as its feed.

EXAMPLE 4

As shown in Table B, each paper, to both surfaces of which polyethylene films had been laminated and which had been subjected to corona discharge processing, was coated in turn with the first layer (bottom layer) to the seventh layer (top layer) in order to form photographic paper samples. A coating solution of each layer was prepared by the following procedure. In this connection structural formulae and others of the couplers, dye stabilizers and the like used in the coating solutions will be described hereinafter.

The coating solution of the first layer was prepared as follows: Six hundred milliliters of ethyl acetate as a co-solvent was added to a mixture of 200 g of a yellow coupler, 93.3 g of a color mix inhibitor (r), 10 g of a high-boiling solvent (p), and 5 g of a solvent (q), and the mixture was then heated to 60° C. to dissolve the respective components. Afterward the mixture was added to 3,300 ml of a 5% aqueous gelatin solution containing 330 ml of a 5% aqueous solution of Alkanol B (trade name, alkylnaphthalene sulfonate, Du Pont). Next this solution was emulsified by the use of a colloid mill to prepare a coupler dispersion. From this dispersion ethyl acetate was distilled off, and the dispersion was further added to 1,400 g of an emulsion containing, in addition to 96.7 g of Ag and 170 g of gelatin, a sensitizing dye for a blue-sensitive emulsion layer and 1-methyl-2-mercapto-5-acetylamino-1,3,4-triazole. Moreover, 2,600 g of a 10% aqueous gelatin solution was added thereto, thus preparing a coating solution. Coating solutions for the second to the seventh layers were prepared in accordance with the compositions shown in Table B in the same manner as for the first layer.

The cyan couplers for the fifth layer, however, are shown in the following Table 4, in order to prepare photographic papers.

In this example the following compounds were used.

UV Absorber (n): 2-(2-Hydroxy-3,5-di-tert-amylphenyl)benzotriazole

UV Absorber (o): 2-(2-Hydroxy-3,5-di-tert-butylphenyl)benzotriazole

Solvent (p): Di(2-ethylhexyl)phthalate

Solvent (q): Dibutylphthalate

Discoloration Inhibitor (r): 2,5-Di-tert-amylphenyl-3,5-di-tert-butylhydroxybenzoate Color Mixing Inhibitor (s): 2,5-Di-tert-octylhydroquinone Discoloration Inhibitor (t): 1,4-Di-tert-amyl-2,5-dioctyloxybenzene Discoloration Inhibitor (u): 2,2'-Methylenebis(4-methyl-6-tert-butylphenol)

Further, the following compounds were used as sensitizing dyes for the respective emulsion layers.

Blue-sensitive Emulsion Layer: Anhydro-5-methoxy-5'-methyl-3,3'-disulfopropylselenacyanin hydroxide Green-sensitive Emulsion Layer: Anhydro-9-ethyl-5,5'-diphenyl-3,3'-disulfoethyloxacarbocyanin hydroxide Red-sensitive Emulsion Layer: 3,3'-Diethyl-5-methoxy-9,9'-(2,2-dimethyl-1,3-propano)thiadicarbocyanine iodide The following compounds were used as stabilizers for the respective emulsion layers.

1-Methyl-2-mercapto-5-acetylamino-1,3,4-triazole

The following compounds were used as irradiation preventing dyes.

4-(3-Carboxy-5-hydroxy-4-(3-(3-carboxy-5-oxo-1-(4-sulfonatephenyl)-2-pyrazoline-4-iridene)-1-propenyl)-1-pyrazolyl)benzenesulfonate-dipotassium salt and N,N'-(4,8-dihydroxy-9,10-dioxo-3,7-disulfonateanthracene-1,5-diyl)bis(aminomethane sulfonate)-tetrasodium salt.

1,2-Bis(vinylsulfonyl)ethane was used as a hardening agent.

The following compounds were used as couplers.

Yellow Coupler

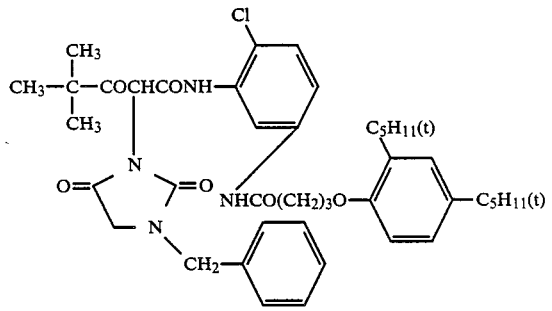

Magenta Coupler

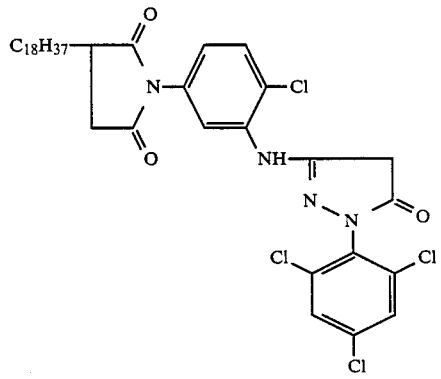

Cyan Coupler

See Table 4.

The thus-prepared multi-layer color photographic papers were exposed through an optical wedge and then processed through the following steps:

-continued

| Processing Step | Time | Temp. |
|---|---|---|
| Drying | 1 min | 80° C. |

The following processing solutions were used in these steps.

| | |
|---|---|
| Color Developing Solution | |
| Water | 800 ml |
| Sodium sulfite | see Table 4 |
| Hydroxylamine.sulfate | 3.0 g |
| Chelating agent | $2 \times 10^{-2}$ mol |
| Potassium bromide | |
| Additive A (a compound of general formula (I) or another) | see Table 4 |
| Potassium carbonate | 30 g |
| 3-Methyl-4-amino-N—ethyl-N—[β-(methanesulfonamide)ethyl]-aniline sulfate | 5.5 g |
| Fluorescent brightening agent (4,4'-diaminostilbene series) | 1.0 g |
| Water | q.s. to 1000 ml |
| pH | 10.10 (with KOH) |
| Bleach-fixing Solution | |
| Ammonium thiosulfate (70%) | 150 ml |
| Sodium sulfite | 15 g |
| Ethylenediamine iron (III) ammonium | 60 g |
| Ethylenediaminetetraacetic acid | 10 g |
| Fluorescent brightening agent (4,4'-diaminostilbene series) | 1.0 g |
| 2-Mercapto-5-amino-3,4-thiadiazole | 1.0 g |
| Water | q.s. to 1000 ml |
| pH | 7.0 (with ammonia water) |
| Rinsing Solution | |
| 5-Chloro-2-methyl-4-isothiazoline-3-one | 40 mg |
| 2-Methyl-4-isothiazoline-3-one | 10 mg |
| 2-Octyl-4-isothiazoline-3-one | 10 mg |
| Bismuth chloride (40%) | 0.5 g |
| Nitro-N,N,N—trimethylenephosphonic acid (40%) | 1.0 g |
| 1-Hydroxyethylidene-1,1-diphosphonic acid (60%) | 2.5 g |
| Fluorescent brightening agent (4,4'-diaminostilbene series) | 1.0 g |
| Ammonia water (26%) | 2.0 m |
| Water | q.s. to 1000 ml |
| pH | 7.5 (with KOH) |

| Processing Step | Time | Temp. |
|---|---|---|
| Color Development | 3 min 30 sec | 38° C. |
| Bleach-fixing | 1 min 30 sec | 33° C. |
| Rinsing (3-tank cascade) | 3 min | 30° C. |

In the above processing gradation and Dmin of the cyan were measured in the same manner as in Example 2 for a fresh solution of the color developing solution and a stood solution prepared by allowing part of the color developing solution to stand at 40° C. for 14 days.

The increased Dmin and gradation of the stood solution to the fresh solution are set forth in Table 4.

TABLE 4

| Test No. | Cyan Coupler | Sodium Sulfite | Chelating Agent | Additive A ($4 \times 10^{-2}$ mol) | Change of Photographic Characteristic Dmin | Gradation | Remarks |
|---|---|---|---|---|---|---|---|
| 1 | C-9 | 1.8 | Diethylenetriamine-hexaacetic acid | 1-(1) | +0.05 | +0.20 | Comparative Example |
| 2 | C-1 | 1.8 | " | " | +0.05 | +0.19 | " |
| 3 | C-9 | 0 | " | " | +0.06 | +0.13 | " |
| 4 | C-1 | 0 | (68) | Triethanolamine | +0.06 | +0.14 | " |
| 5 | C-9 | 0 | " | Polyethyleneimine | +0.06 | +0.14 | " |
| 6 | Coupler-A* | 1.8 | " | 1-(1) | +0.04 | +0.10 | This invention |
| 7 | Coupler-B* | 1.8 | " | " | +0.04 | +0.10 | " |
| 8 | C-9 | 1.8 | " | " | 0 | +0.09 | " |
| 9 | C-1 | 1.8 | " | " | 0 | +0.08 | " |
| 10 | Coupler-A* | 0 | " | " | +0.03 | +0.04 | " |
| 11 | Coupler-B* | 0 | " | " | +0.03 | +0.05 | " |
| 12 | C-9 | 0 | " | " | 0 | +0.01 | " |
| 13 | C-1 | 0 | " | " | 0 | +0.01 | " |
| 14 | Coupler-A* | 0 | (57) | " | +0.03 | +0.06 | " |

TABLE 4-continued

| Test No. | Cyan Coupler | Sodium Sulfite | Chelating Agent | Additive A ($4 \times 10^{-2}$ mol) | Change of Photographic Characteristic Dmin | Gradation | Remarks |
|---|---|---|---|---|---|---|---|
| 15 | C-9 | 0 | " | " | +0 | +0.02 | " |
| 16 | C-1 | 0 | " | " | 0 | +0.02 | " |
| 17 | C-1 | 0.5 | " | " | 0 | +0.06 | " |
| 18 | C-1 | 1.0 | " | " | +0.01 | +0.06 | " |
| 19 | C-1 | 1.8 | " | " | +0.01 | +0.09 | " |

*Cyan Coupler:

A: 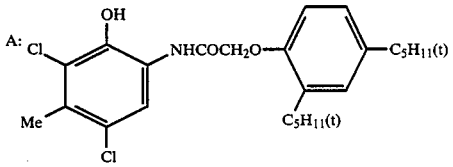

B: 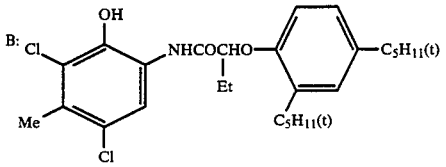

As is apparent from the results in Table 4 regarding the developing solution allowed to stand for 14 days in Test Nos. 6 to 18, variations in the gradation and the Dmin are smaller than in Test Nos. 1 to 5. It can therefore be stated that the developing solutions in Test Nos. 6 to 18 are excellent in photographic stability. In particular, in Test Nos. 8, 9, 12, 13, 15, 16, 17, 18, and 19, in which C-9 and C-1 are used as the cyan couplers, and in Test Nos. 10 to 17 in which concentration of sulfurous acid in the developing solutions is low, it is appreciated that photographic stability is more stabilized.

EXAMPLE 5

The same procedure as in No. 13 of Example 4 was repeated with the exception that chelating agents (3), (10), (13), (25), (26), (28), (49), (58), and (65) were combined with additives 1-(1), 1-(2), 1-(6), 1-(7), 1-(11) and 1-(16), such that excellent photographic characteristics were obtained, as in No. 13 of Example 4.

EXAMPLE 6

The same procedure as in Test Nos. 1 to 21 of Example 2 was repeated with the exception that the following color photographic papers were used instead, and the results in Test Nos. 5 to 21 were indicative that the change in photographic characteristics regarding this invention were advantageously small.

Multi-layer color photographic papers were prepared by forming the following layer structures on each paper base that had been laminated on both sides with polyethylene. Coating solutions were prepared by mixing emulsions, various chemicals and coupler emulsions with one another, followed by dissolving, as follows:

PREPARATION OF COUPLER EMULSION

Yellow coupler emulsion was prepared in the same procedure of Example 2.

In like manner, emulsions for magenta, cyan and intermediate layers were prepared. The respective emulsions used here were prepared as followed:

(ExY): Yellow coupler
Same as Example 2

(ExM-1): Magenta coupler
Same as Example 2

(ExC-1): Cyan coupler

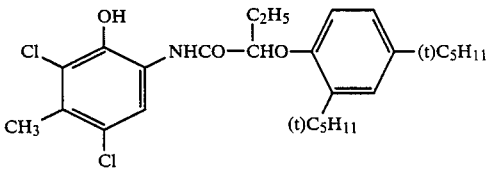

(ExC-2): Cyan coupler

-continued

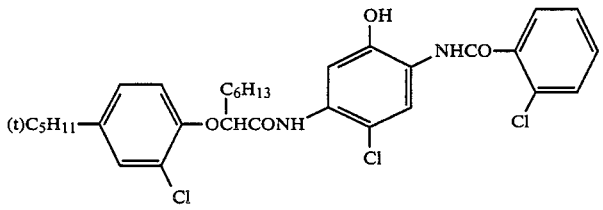

(Cpd-1): Image Dye stabilizer,
(Cpd-2): Color mix inhibitor,
(Cpd-3): Image dye stabilizer,
(Cpd-4): Image dye stabilizer and
(Cpd-5): Color mix inhibitor
Same as Example 2

(Cpd-6): Image dye stabilizer

6a

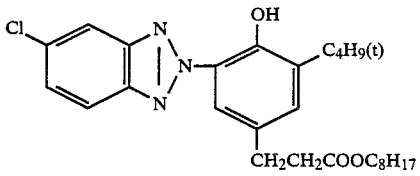

6b

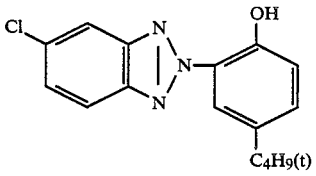

6c

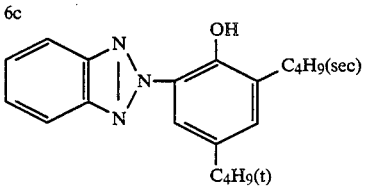

(mixture in weight ratio of 6a:6b:6c = 5:8:9)

(Cpd-7): Polymer
Same as Example 2

(UV-1): UV absorber
Mixture in weight ratio of 6a:6b:6c = 2:9:8 shown in (Cpd-6)

(Solv-1): Solvent
Same as Example 2

(Solv-2): Solvent $O{=}P{+}O{-}C_8H_{17}(iso))_3$ (Solv-3): Solvent, and (Solv-4): Solvent
Same as Example 2

The following dye was added to prevent the respective emulsion layers for irradiation.

Red-sensitive emulsion layer: Dye-R

-continued

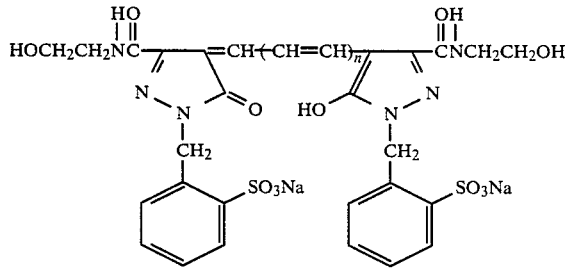

wherein n = 2

-continued

Green-sensitive emulsion layer

Same as Dye-R, but n = 1

To the red-sensitive emulsion layer, the following compound was added in amount of $2.6\times10^{-3}$ mol per of a silver halide.

Emulsions used in this Example were as follows:

Blue-sensitive emulsion: A monodisperse cubic silver halide emulsion (containing $K_2IrCl_6$ and 1,3-dimethylimidazoline-2-thione) having an average grain size of 1.1 μm and a coefficient of variation (a value obtained by dividing the standard deviation by the average grain size=s/d) of 0.10 was prepared in the usual way. To 1.0 kg of the thus-prepared emulsion was added 26 ml of a 0.6% solution of a blue spectral sensitization dye (S-1), and an emulsion of 0.05 μm silver bromide fine grains was further added thereto in a ratio of 0.5 mol% with respect to the host silver chloride emulsion. After ripening, sodium thiosulfate was added thereto and optimum chemical sensitization was then achieved, and a stabilizer (Stb-1) was added thereto in a proportion of $10^{-4}$ mol per mol of Ag in order to prepare a blue-sensitive emulsion.

Green-sensitive Emulsion: Silver chloride grains containing $K_2IrCl_6$ and 1,3-dimethylimidazoline-2-thione were prepared in the usual way, and a sensitizing dye (S-2) was added thereto in a ratio of $4\times10^{-4}$ mol per mol of Ag. KBr was further added thereto, and after ripening, sodium thiosulfate was added thereto and optimum chemical sensitization was then achieved. A stabilizer (Stb-1) was added thereto in a ratio of $5\times10^{-4}$ mol per mol of Ag in order to prepare a monodisperse cubic silver chloride emulsion having an average grain size of 0.48 μm and a coefficient of variation of 0.10.

Red-sensitive Emulsion: The same procedure as for the green-sensitive emulsion was repeated with the exception that a sensitizing dye (S-3) was substituted for (S-2) in a ratio of $1.5\times10^{-4}$ mol per mol of Ag, in order to prepare a red-sensitive emulsion.

The following compounds were used in this Example:

(S-1): Sensitizing dye

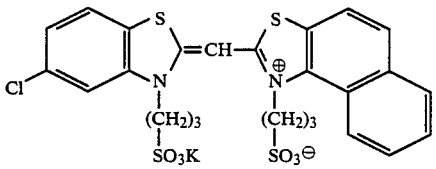

(S-2): Sensitizing dye

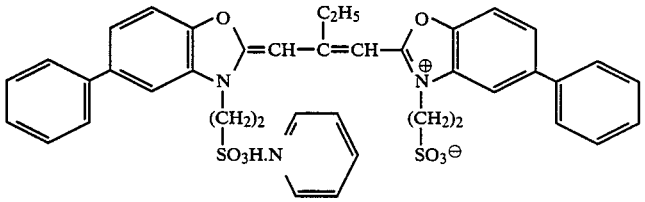

(S-3): Sensitizing dye

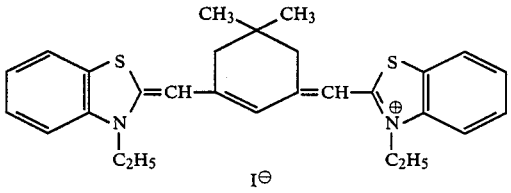

(Stb-1): Stabilizer

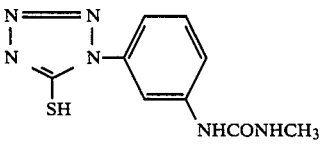

COMPOSITION OF LAYERS

Composition of the respective layers in the sample were as follows. Figures represent coating amounts ($g/m^2$). The amount of each silver halide emulsion was represented by a coating amount in terms of silver.

| Supporting base | |
|---|---|
| Same as Example 2 | |
| First layer: Blue-sensitive layer | |
| Silver halide emulsion | 0.30 |
| Gelatin | 1.86 |
| Yellow coupler (ExY) | 0.82 |

-continued

| Supporting base | |
|---|---|
| Image dye stabilizer (Cpd-1) | 0.19 |
| Solvent (Solv-1) | 0.35 |
| Second layer: Color mix inhibitor | |
| Same as Example 2 | |
| Third layer: Green-sensitive layer | |
| Silver halide emulsion | 0.36 |
| Gelatin | 1.24 |
| Magenta coupler (ExM-1) | 0.31 |
| Image dye stabilizer (Cpd-3) | 0.25 |
| Image dye stabilizer (Cpd-4) | 0.12 |
| Solvent (Solv-2) | 0.42 |
| Fourth layer: UV absorbing layer | |
| Gelatin | 1.58 |
| UV absorber (UV-1) | 0.62 |
| Color mix inhibitor (Cpd-5) | 0.05 |
| Solvent (Solv-3) | 0.24 |
| Fifth layer: Red-sensitive layer | |
| Silver halide emulsion | 0.23 |
| Gelatin | 1.34 |
| Cyan coupler (mixture in a ratio 1:1 of ExC-1 and ExC-2) | 0.34 |
| Image dye stabilizer (Cpd-6) | 0.17 |
| Polymer (Cpd-7) | 0.40 |
| Solvent (Solv-4) | 0.23 |
| Sixth layer: UV absorbing layer | |
| Gelatin | 0.53 |
| UV absorber (UV-1) | 0.21 |
| Solvent (Solv-3) | 0.08 |
| Seventh layer: Protective layer | |
| Same as Example 2 | |

1-Oxy-3,5-dichloro-s-triazine sodium salt was used as a hardening agent for each layer.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for processing a silver halide color photographic material, which comprises processing the silver halide color photographic material with a color developing solution comprising an aromatic primary amine color developing agent, at least one organic phosphonic acid type chelating agent and at least one compound represented by the following formula (I):

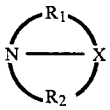

Formula (I)

wherein X represents a trivalent group of atoms required to complete a condensed ring, and $R_1$ and $R_2$ each represent an alkylene group, an arylene group, an alkenylene group or an aralkylene group.

2. The method for processing as claimed in claim 1, wherein the number of carbon atoms of X is 20 or below, and the number of carbon atoms of $R_1$ and $R_2$ each is 10 or below.

3. The method for processing as claimed in claim 1, wherein the compound represented by the formula (I) is a compound represented by the following formula (I-a) or (I-b):

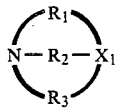

Formula (I-a)

wherein $X_1$ represents

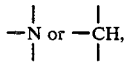

$R_1$ and $R_2$ each have the same meaning as defined in formula (I), and $R_3$ has the same meaning as $R_1$ and $R_2$, or represents

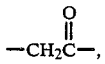

or

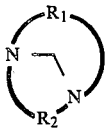

Formula (I-b)

wherein $R_1$ and $R_2$ each have the same meaning as defined in formula (I).

4. The method for processing as claimed in claim 1, wherein the compound represented by the formula (I) is included in an amount of 0.1 to 50 g per liter of the color developing solution.

5. The method for processing as claimed in claim 1, wherein the compound represented by the formula (I) is included in an amount of 0.2 to 20 g per liter of the color developing solution.

6. The method for processing as claimed in claim 1, wherein organic phosphonic acid is an alkylphosphonic acid, a phosphonocarboxylic acid or an aminopolyphosphonic acid.

7. The method for processing as claimed in claim 1, wherein said organic phosphonic acid is selected from compounds represented by the following formula (III):

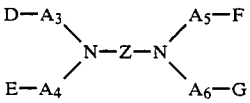

Formula (III)

wherein $A_3$, $A_4$, $A_5$ and $A_6$ each represent a alkylene group, Z represents an alkylene group, a cyclohexane group, a phenylene group, —R—O—R—, —ROROR—,

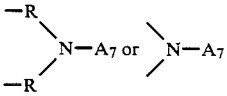

(wherein R represents an alkylene group, and $A_7$ represents a hydrogen atom, or a hydrocarbon, lower aliphatic carboxylic acid or lower alcohol group), and D, E, F and G each represent —OH, —COOM, or —$PO_3M_2$ (wherein M represents a hydrogen atom, an alkali metal, or ammonium), provided that at least one of D, E, F and G is —$PO_3M_2$.

8. The method for processing as claimed in claim 1, wherein the organic phosphonic acid type chelating agent is included in an amount of 0.1 to 40 g per liter of the color developing solution.

9. The method for processing as claimed in claim 1, wherein the color developing solution is substantially free of benzyl alcohol.

10. The method for processing as claimed in claim 1, wherein as a cyan coupler in the silver halide color photographic material at least one cyan coupler represented by the following formula (XI):

Formula (XI)

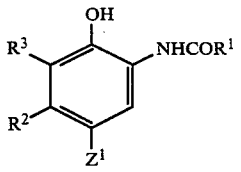

wherein $R^1$ represents an alkyl group, cycloalkyl group, aryl group, amino group, or heterocyclic group, $R^2$ represents an acylamino group or alkyl group containing more than 2 carbon atoms, $R^3$ represents a hydrogen atom, halogen atom, alkyl group, or alkoxy group, $R^3$ may form a ring by being combined with $R^2$, $Z^1$ represents a hydrogen atom, halogen atom, or group capable of splitting-off by a coupling reaction with an oxidized aromatic primary amine main color developing agent.

11. The method for processing as claimed in claim 1, wherein as a magenta coupler in the silver halide color photographic material at least one pyrazoloazole system coupler is used.

12. A color developing composition for processing a silver halide color photographic material, which comprises an aromatic primary amine color developing agent, at least one organic phosphonic acid type chelating agent and at least one compound represented by the following formula (I):

Formula (I)

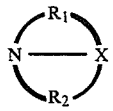

wherein X represents a trivalent group of atoms required to complete a condensed ring, and $R_1$ and $R_2$ each represent an alkylene group, an arylene group, an alkylene group or an aralkylene group.

13. The composition as claimed in claim 12, wherein the number of carbon atoms of X is 20 or below, and the number of carbon atoms of $R_1$ and $R_2$ each is 10 or below.

14. The composition as claimed in claim 12, wherein the compound represented by the formula (I) is a compound represented by the following formula (I-a) or (I-b):

Formula (I-a)

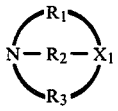

wherein $X_1$ represents

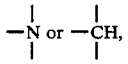

$R_1$ and $R_2$ each have the same meaning as defined in formula (I), and $R_3$ has the same meaning as $R_1$ and $R_2$, or represents

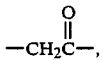

or

Formula (I-b)

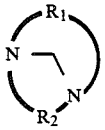

wherein $R_1$ and $R_2$ each hae the same meaning as defined in formula (I).

15. The composition as claimed in claim 12, wherein the compound represented by the formula (I) is included in an amount of 0.1 to 50 g per liter of the color developing composition.

16. The composition as claimed in claim 12, wherein the compound represented by the formula (I) is included in an amount of 0.2 to 20 g per liter of the color developing composition.

17. The composition as claimed in claim 12, wherein organic phosphonic acid is an alkylphosphonic acid, a phosphonocarboxylic acid or an aminopolyphosphonic acid.

18. The composition as claimed in claim 12, wherein said organic phosphonic acid is selected from compounds represented by the following formula (III):

Formula (III)

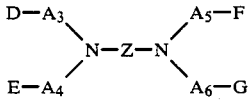

wherein $A_3$, $A_4$, $A_5$ and $A_6$ each represent a alkylene group, Z represents an alkylene group, a cyclohexane group, a phenylene group, —R—O—R—, —ROROR—,

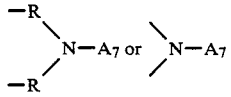

(wherein R represents an alkylene group, and $A_7$ represents a hydrogen atom, or a hydrocarbon, lower aliphatic carboxylic acid or lower alcohol group), and D, E, F and G each represent —OH, —COOM, or —$PO_3M_2$ (wherein M represents a hydrogen atom, an alkali metal, or ammonium), provided that at least one of D, E, F and G is —$PO_3M_2$.

19. The composition as claimed in claim 12, wherein the organic phosphonic acid type chelating agent is included in an amount of 0.1 to 40 g per liter of the composition.

20. The composition as claimed in claim 12, wherein the composition is substantially free of benzyl alcohol.

* * * * *